US010957959B2

(12) United States Patent
Ashida et al.

(10) Patent No.: US 10,957,959 B2
(45) Date of Patent: Mar. 23, 2021

(54) BAND-PASS FILTER

(71) Applicant: TDK CORPORATION, Tokyo (JP)

(72) Inventors: Yuta Ashida, Tokyo (JP); Noriyuki Hirabayashi, Tokyo (JP); Shigemitsu Tomaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/552,015

(22) Filed: Aug. 27, 2019

(65) Prior Publication Data

US 2020/0106148 A1 Apr. 2, 2020

(30) Foreign Application Priority Data

Oct. 1, 2018 (JP) ..... JP2018-186861

(51) Int. Cl.
*H01P 1/203* (2006.01)
*H01P 5/12* (2006.01)

(52) U.S. Cl.
CPC ..... *H01P 1/20345* (2013.01); *H01P 1/203* (2013.01); *H01P 1/20327* (2013.01); *H01P 1/20336* (2013.01); *H01P 1/20381* (2013.01); *H01P 5/12* (2013.01)

(58) Field of Classification Search
CPC ..... H01P 1/20; H01P 1/203; H01P 1/20327; H01P 1/20336; H01P 1/20345; H01P 1/20381
USPC ..... 333/204, 205
See application file for complete search history.

(56) References Cited

U.S. PATENT DOCUMENTS

2013/0049894 A1* 2/2013 Hendry ..... H01P 7/105 333/202

FOREIGN PATENT DOCUMENTS

JP 2003-069306 A 3/2003
JP 2006-311100 A 11/2006

* cited by examiner

*Primary Examiner* — Rakesh B Patel
(74) *Attorney, Agent, or Firm* — Oliff PLC

(57) ABSTRACT

A band-pass filter includes first to sixth stage resonators. Each resonator includes a resonator conductor portion formed of a conductor line. The resonator conductor portion has a first end and a second end which are opposite ends of the conductor line. The resonator conductor portion of each of the first and sixth stage resonators includes a narrow portion, a first wide portion located between the narrow portion and the first end, and a second wide portion located between the narrow portion and the second end. Each of the first and sixth stage resonators is lower in unloaded Q than the other resonators.

14 Claims, 17 Drawing Sheets

BAND-PASS FILTER

BACKGROUND OF THE INVENTION

1. Field of the Invention

The present invention relates to a band-pass filter including a plurality of resonators.

2. Description of the Related Art

The standardization of fifth-generation mobile communication systems (hereinafter referred to as 5G) is currently ongoing. For 5G, the use of frequency bands of 10 GHz or higher, particularly a quasi-millimeter wave band of 10 to 30 GHz and a millimeter wave band of 30 to 300 GHz, is being studied to expand the frequency band.

One of electronic components used in a communication apparatus is a band-pass filter including a plurality of resonators. Each of the plurality of resonators includes, for example, a conductor portion that is long in one direction.

JP2006-311100A describes a chip-type multistage filter device usable in quasi-millimeter and millimeter wave bands. The chip-type multistage filter device includes a multilayer substrate, first and second surface ground electrodes, first and second internal ground electrodes, and first and second $\lambda/2$ resonator electrodes. The multilayer substrate is formed by stacking a plurality of dielectric layers. The multilayer substrate has first and second main surfaces opposed to each other, and first to fourth side surfaces connecting the first and second main surfaces. The first side surface and the second side surface are opposed to each other. The first surface ground electrode is disposed on the first side surface. The second surface ground electrode is disposed on the second side surface. The first internal ground electrode is disposed on one of the dielectric layers of the multilayer substrate that is relatively close to the first main surface. The second internal ground electrode is disposed on another one of the dielectric layers of the multilayer substrate that is relatively close to the second main surface. The first and second $\lambda/2$ resonator electrodes are disposed in an area surrounded by the first and second surface ground electrodes and the first and second internal ground electrodes.

JP2003-069306A describes a band-pass filter comprising a plurality of resonators, each of the resonators having a configuration in which a low-impedance line, a high-impedance line, and a low-impedance line are connected in this order. The resonator having such a configuration is a kind of stepped impedance resonator (hereinafter referred to as SIR).

Band-pass filters for use particularly with communication apparatuses of miniature size must undergo miniaturization. However, a band-pass filter that includes a plurality of half-wave resonators, such as the one described in JP2006-311100A, is difficult to miniaturize since the half-wave resonators are large in length.

Reduction in length of the half-wave resonators can be achieved by using SIRs, as described in JP2003-069306A, as the half-wave resonators. However, compared to a resonator formed of a conductor line of constant width, SIRs are lower in unloaded Q. A lower unloaded Q of resonators leads to a higher insertion loss of the band-pass filter. Thus, if all the resonators are configured as SIRs as described in JP2003-069306A, an excessively high insertion loss of the band-pass filter would result.

SUMMARY OF THE INVENTION

It is an object of the present invention to provide a band-pass filter that includes a plurality of resonators and achieves miniaturization while preventing an increase in insertion loss.

A band-pass filter of the present invention includes: a main body formed of a dielectric; a first input/output port and a second input/output port integrated with the main body; and N resonators. N is an integer greater than or equal to 3. The N resonators are provided within the main body, located between the first input/output port and the second input/output port in circuit configuration, and configured so that electromagnetic coupling is established between every two of the resonators adjacent to each other in circuit configuration.

The N resonators include at least a pair of first and second resonators, the first and second resonators being non-adjacent to each other in circuit configuration, and a third resonator located between the first and second resonators in circuit configuration. When one of the N resonators that is i-th closest to the first input/output port in circuit configuration is referred to as an i-th stage resonator, the first resonator is an i-th stage resonator where i has a value smaller than (N+1)/2, and the second resonator is an i-th stage resonator where i has a value greater than (N+1)/2.

The first resonator includes a first resonator conductor portion formed of a conductor line. The second resonator includes a second resonator conductor portion formed of a conductor line. The third resonator includes a third resonator conductor portion formed of a conductor line. Each of the first to third resonator conductor portions has a first end and a second end which are opposite ends of the conductor line. Each of the first and second resonator conductor portions includes a narrow portion, a first wide portion located between the narrow portion and the first end, and a second wide portion located between the narrow portion and the second end. The narrow portion is smaller in width than the first and second wide portions, the width being a dimension in a direction orthogonal to a shortest path connecting the first end and the second end. Each of the first and second resonators is lower in unloaded Q than the third resonator.

In the band-pass filter of the present invention, each of the first to third resonators may be a resonator with open ends.

In the band-pass filter of the present invention, the third resonator conductor portion may include no portion having a width smaller than a width at each of the first end and the second end.

In the band-pass filter of the present invention, each of the first and second resonator conductor portions may be smaller in length of the shortest path than the third resonator conductor portion.

In the band-pass filter of the present invention, the first resonator may be a first stage resonator, and the second resonator may be an N-th stage resonator.

In the band-pass filter of the present invention, N may be an integer greater than or equal to 5. In such a case, the N resonators may include a first pair of first and second resonators, and a second pair of first and second resonators. The first resonator of the first pair of first and second resonators may be a first stage resonator, and the second resonator of the first pair of first and second resonators may be an N-th stage resonator. The first resonator of the second pair of first and second resonators may be a second stage resonator, and the second resonator of the second pair of first and second resonators may be an N−1-th stage resonator.

According to the band-pass filter of the present invention, each of the first and second resonator conductor portions includes a narrow portion, and each of the first and second resonators is lower in unloaded Q than the third resonator. Further, the first resonator is an i-th stage resonator where i has a value smaller than (N+1)/2, and the second resonator is an i-th stage resonator where i has a value greater than (N+1)/2. By virtue of these features, it becomes possible for the band-pass filter of the present invention to achieve miniaturization while preventing an increase in insertion loss.

Other and further objects, features and advantages of the invention will appear more fully from the following description.

DETAILED DESCRIPTION OF THE PREFERRED EMBODIMENTS

First Embodiment

Figure 1:
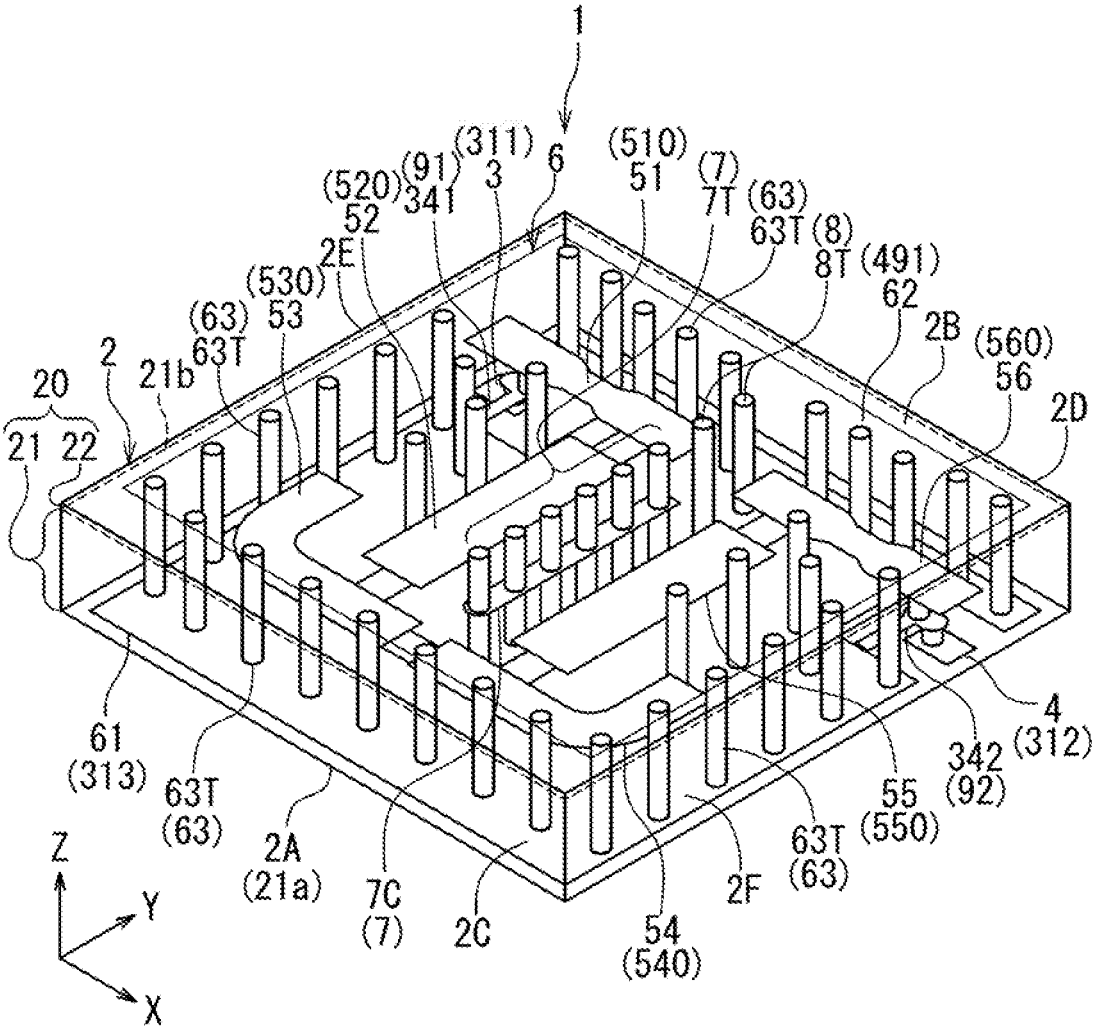
FIG. 1 is a perspective view showing the structure of a band-pass filter according to a first embodiment of the invention.
Figure 2:
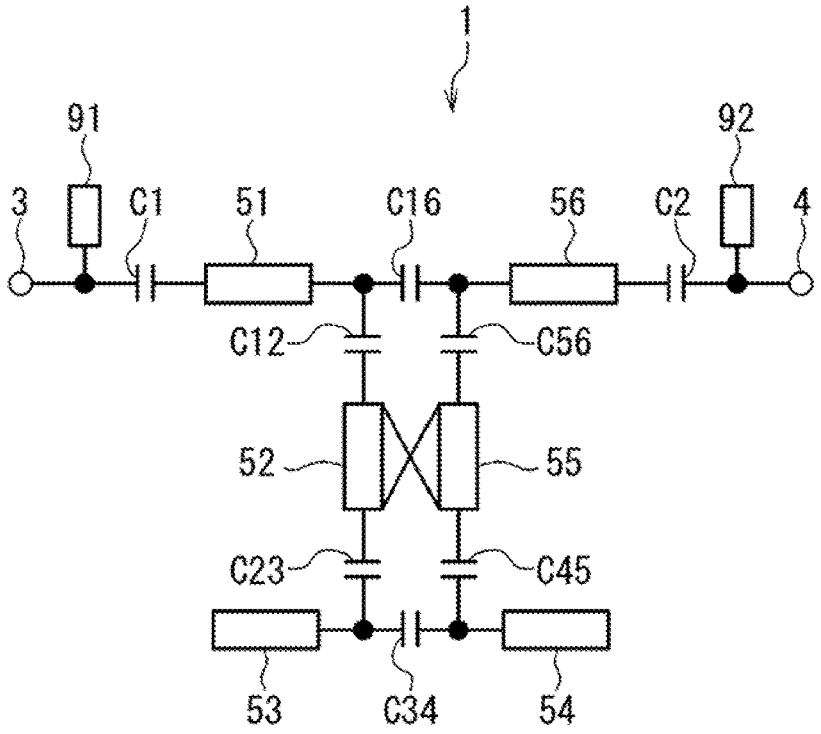
FIG. 2 is a circuit diagram showing the circuit configuration of the band-pass filter according to the first embodiment of the invention.

Preferred embodiments of the present invention will now be described in detail with reference to the drawings. First, reference is made to FIG. 1 and FIG. 2 to describe the configuration of a band-pass filter according to a first embodiment of the invention. FIG. 1 is a perspective view showing the structure of the band-pass filter according to the present embodiment. FIG. 2 is a circuit diagram showing the circuit configuration of the band-pass filter according to the present embodiment.

As shown in FIG. 1, the band-pass filter 1 according to the present embodiment includes: a main body 2 formed of a dielectric; a first input/output port 3 and a second input/output port 4 integrated with the main body 2; N resonators provided within the main body 2; a shield 6; a partition 7; and a coupling adjustment section 8. N is an integer greater than or equal to 3. The shield 6 is formed of a conductor and integrated with the main body 2. The shield 6 is connected to the ground. The shield 6 has the function of preventing electromagnetic radiation to the surroundings of the band-pass filter 1. Each of the partition 7 and the coupling adjustment section 8 is formed of a conductor, provided within the main body 2 and electrically connected to the shield 6.

The main body 2 includes a multilayer stack 20 composed of a plurality of dielectric layers stacked together. Here, X, Y and Z directions are defined as shown in FIG. 1. The X, Y and Z directions are orthogonal to one another. In the present embodiment, the direction in which the plurality of dielectric layers are stacked is the Z direction (the upward direction in FIG. 1).

The main body 2 has a rectangular parallelepiped shape. The main body 2 has a first end face 2A and a second end face 2B located at opposite ends in the Z direction of the main body 2, and further has four side surfaces 2C, 2D, 2E and 2F connecting the first end face 2A and the second end face 2B. The first end face 2A is also the bottom surface of the main body 2. The second end face 2B is also the top surface of the main body 2. The side surfaces 2C and 2D are located at opposite ends in the Y direction of the main body 2. The side surfaces 2E and 2F are located at opposite ends in the X direction of the main body 2.

The N resonators are located between the first input/output port 3 and the second input/output port 4 in circuit configuration. The N resonators are configured so that electromagnetic coupling is established between every two of the resonators adjacent to each other in circuit configuration. As used herein, the phrase "in circuit configuration" is to describe layout in a circuit diagram, not in a physical configuration.

In the present embodiment, as shown in FIG. 2, N is specifically 6, and the N resonators are six resonators 51, 52, 53, 54, 55 and 56. The six resonators 51, 52, 53, 54, 55 and 56 are arranged in this order, from closest to farthest, from the first input/output port 3 in circuit configuration. The resonators 51 to 56 are configured so that the resonators 51 and 52 are adjacent to each other in circuit configuration and are electromagnetically coupled to each other, the resonators 52 and 53 are adjacent to each other in circuit configuration and are electromagnetically coupled to each other, the resonators 53 and 54 are adjacent to each other in circuit configuration and are electromagnetically coupled to each other, the resonators 54 and 55 are adjacent to each other in circuit configuration and are electromagnetically coupled to each other, and the resonators 55 and 56 are adjacent to each other in circuit configuration and are electromagnetically coupled to each other. In the present embodiment, the electromagnetic coupling between every two of the resonators adjacent to each other in circuit configuration is specifically capacitive coupling. In the present embodiment, each of the resonators 51 to 56 is a resonator with open ends, and also a half-wave resonator.

The band-pass filter 1 includes a capacitor C12 for establishing capacitive coupling between the resonators 51 and 52, a capacitor C23 for establishing capacitive coupling between the resonators 52 and 53, a capacitor C34 for establishing capacitive coupling between the resonators 53 and 54, a capacitor C45 for establishing capacitive coupling between the resonators 54 and 55, and a capacitor C56 for establishing capacitive coupling between the resonators 55 and 56.

In a band-pass filter including three or more resonators configured so that every two of the resonators adjacent to each other in circuit configuration are coupled to each other, electromagnetic coupling may be established between two resonators that are not adjacent to each other in circuit configuration. Such electromagnetic coupling between non-adjacent resonators will be referred to as cross coupling. As will be described in detail below, the band-pass filter 1 according to the present embodiment has two cross couplings.

In the present embodiment, among the six resonators 51 to 56, the resonator 52, which is the second closest to the first input/output port 3 in circuit configuration, and the resonator 55, which is the second closest to the second input/output port 4 in circuit configuration, are magnetically coupled to each other although they are not adjacent to each other in circuit configuration.

Further, in the present embodiment, among the six resonators 51 to 56, the resonator 51, which is the closest to the first input/output port 3 in circuit configuration, and the resonator 56, which is the closest to the second input/output port 4 in circuit configuration, are capacitively coupled to each other although they are not adjacent to each other in circuit configuration. In FIG. 2, the capacitor symbol C16 represents the capacitive coupling between the resonators 51 and 56.

The band-pass filter 1 further includes a capacitor C1 provided between the first input/output port 3 and the resonator 51, and a capacitor C2 provided between the second input/output port 4 and the resonator 56.

The band-pass filter 1 further includes a notch filter section for attenuating a signal of a predetermined frequency (hereinafter referred to as a notch frequency) higher than the passband. The notch filter section includes two lines 91 and 92 each formed of a conductor. Each of the lines 91 and 92 has a first end and a second end opposite to each other. The first end of the line 91 is connected to the first input/output port 3, and the second end of the line 91 is open. The first end of the line 92 is connected to the second input/output port 4, and the second end of the line 92 is open. Each of the lines 91 and 92 has a length of one quarter or nearly one quarter the wavelength corresponding to the notch frequency. Each of the lines 91 and 92 is a quarter-wave resonator that resonates at the notch frequency. The notch frequency is, for example, twice the center frequency of the passband of the band-pass filter 1.

The shield 6 includes a first portion 61 and a second portion 62 spaced from each other in the Z direction, and a connecting portion 63 connecting the first portion 61 and the second portion 62. The first portion 61, the second portion 62 and the connecting portion 63 are arranged to surround the six resonators 51 to 56.

The multilayer stack 20 includes a main portion 21 and a coating portion 22. The main portion 21 is composed of two or more dielectric layers stacked together, among the plurality of dielectric layers constituting the multilayer stack 20. The coating portion 22 is composed of one or more dielectric layers other than the two or more dielectric layers constituting the main portion 21, among the plurality of dielectric layers constituting the multilayer stack 20. The main portion 21 has a first end face 21*a* and a second end face 21*b* located at opposite ends in the direction in which the two or more dielectric layers are stacked. The coating portion 22 covers the second end face 21*b*. The first end face 21*a* of the main portion 21 coincides with the first end face 2A of the main body 2. The second end face 21*b* of the main portion 21 is located within the main body 2.

The first portion 61 is formed of a first conductor layer 313 disposed on the first end face 21*a*. The second portion 62 is formed of a second conductor layer 491 disposed on the second end face 21*b*. The second portion 62 is interposed between the main portion 21 and the coating portion 22.

The resonators 51, 52, 53, 54, 55, and 56 respectively include resonator conductor portions 510, 520, 530, 540, 550, and 560 each of which is formed of a conductor line. Each of the resonator conductor portions 510, 520, 530, 540, 550 and 560 extends in a direction orthogonal to the Z direction.

Each of the resonator conductor portions 510, 520, 530, 540, 550 and 560 has a first end and a second end which are opposite ends of the conductor line. As mentioned above, each of the resonators 51 to 56 is a resonator with open ends. Thus, both of the first and second ends of each of the resonator conductor portions 510, 520, 530, 540, 550 and 560 are open. Each of the resonator conductor portions 510, 520, 530, 540, 550 and 560 has a length of one half or nearly one half the wavelength corresponding to the center frequency of the passband of the band-pass filter 1.

At least part of the partition 7 extends to pass between the resonator conductor portion 520 and the resonator conductor portion 550 and is in contact with the first portion 61 and the second portion 62. In the present embodiment, specifically, the partition 7 extends in the Z direction. The partition 7 connects the first portion 61 and the second portion 62 via the shortest path.

The partition 7 runs through the two or more dielectric layers constituting the main portion 21. In the present embodiment, the partition 7 includes a plurality of through hole lines 7T each running through the two or more dielectric layers constituting the main portion 21. In FIG. 1, each through hole line 7T is represented by a circular column. Each of the through hole lines 7T includes two or more through holes connected in series. Each of the through hole lines 7T extends in the Z direction. The through hole lines 7T are arranged to be adjacent to each other in the Y direction. In the present embodiment, the number of the through hole lines 7T is six.

The coupling adjustment section 8 is intended to adjust the magnitude of the capacitive coupling between the resonators 51 and 56. The coupling adjustment section 8 includes a plurality of through hole lines 8T each running through the two or more dielectric layers constituting the main portion 21. In FIG. 1, each through hole line 8T is represented by a circular column. Each of the through hole lines 8T includes two or more through holes connected in series. Each of the through hole lines 8T extends in the Z direction and is in contact with the first portion 61 and the second portion 62. The through hole lines 8T are arranged to be adjacent to each other in the Y direction in the vicinity of the second end of the resonator conductor portion 510 and the second end of the resonator conductor portion 560. In the present embodiment, the number of the through hole lines 8T is two.

The connecting portion 63 of the shield 6 includes a plurality of through hole lines 63T each running through the two or more dielectric layers constituting the main portion 21. In FIG. 1, each through hole line 63T is represented by a circular column. All the through hole lines represented by circular columns in FIG. 1, except the six through hole lines 7T and the two through hole lines 8T, are the through hole lines 63T. Each of the through hole lines 63T includes two or more through holes connected in series. Each of the through hole lines 63T extends in the Z direction.

Reference is now made to FIG. 3 to FIG. 10 to describe an example of the dielectric layers constituting the multilayer stack 20 and the configuration of a plurality of conductor layers formed on the dielectric layers and a plurality of through holes formed in the dielectric layers. In this example, the multilayer stack 20 includes nineteen dielectric layers stacked together. The nineteen dielectric layers will be referred to as the first to nineteenth dielectric layers in the order from bottom to top. The first to nineteenth dielectric layers are denoted by reference numerals 31 to 49, respectively. The main portion 21 is composed of the first to eighteenth dielectric layers 31 to 48. The coating portion 22 is composed of the nineteenth dielectric layer 49. In FIG. 3 to FIG. 9, each circle represents a through hole.

Figure 3:
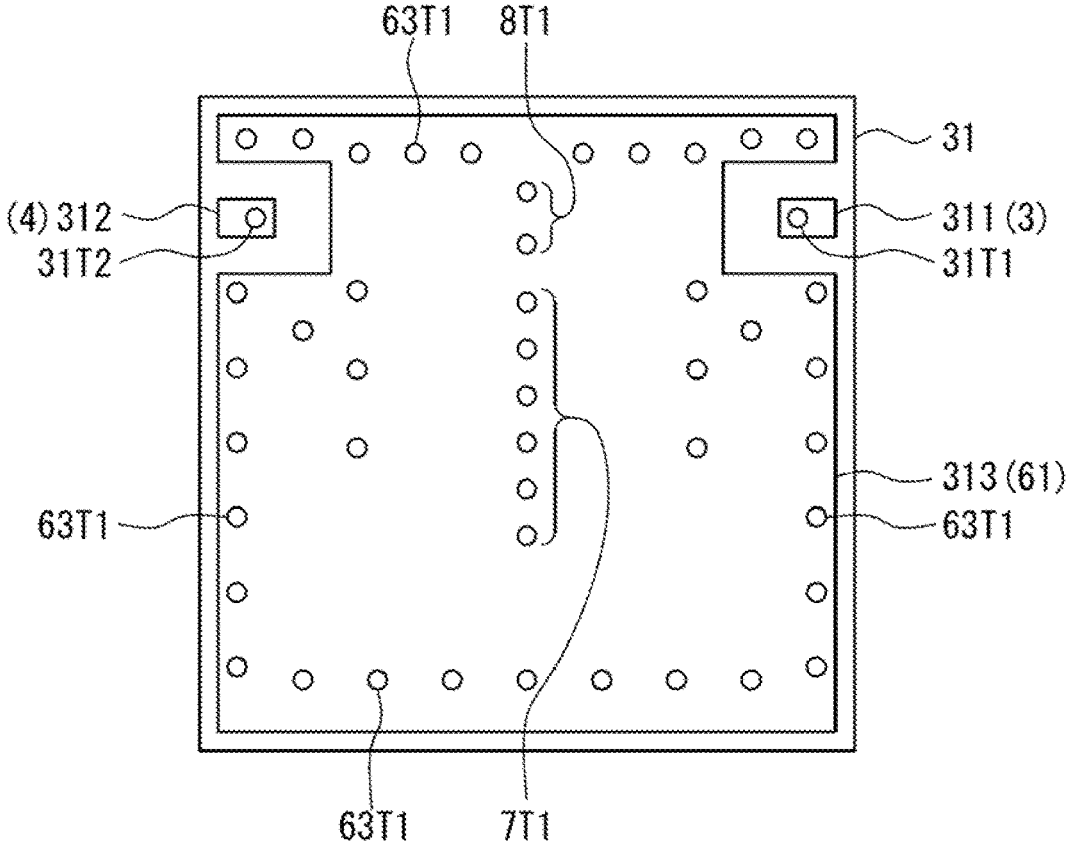
FIG. 3 is an explanatory diagram showing a patterned surface of a first dielectric layer of a multilayer stack shown in FIG. 1.

FIG. 3 shows a patterned surface of the first dielectric layer 31. On the patterned surface of the first dielectric layer 31, there are formed a conductor layer 311 forming the first input/output port 3, a conductor layer 312 forming the second input/output port 4, and the first conductor layer 313 forming the first portion 61 of the shield 6.

Further, a through hole 31T1 connected to the conductor layer 311, and a through hole 31T2 connected to the conductor layer 312 are formed in the dielectric layer 31. Further formed in the dielectric layer 31 are six through holes 7T1 constituting respective portions of the six through hole lines 7T, two through holes 8T1 constituting respective portions of the two through hole lines 8T, and a plurality of through holes 63T1 constituting respective portions of the plurality of through hole lines 63T. All the through holes represented by circles in FIG. 3, except the through holes 31T1, 31T2, 7T1 and 8T1, are the through holes 63T1. The through holes 7T1, 8T1 and 63T1 are connected to the first conductor layer 313.

Figure 4:
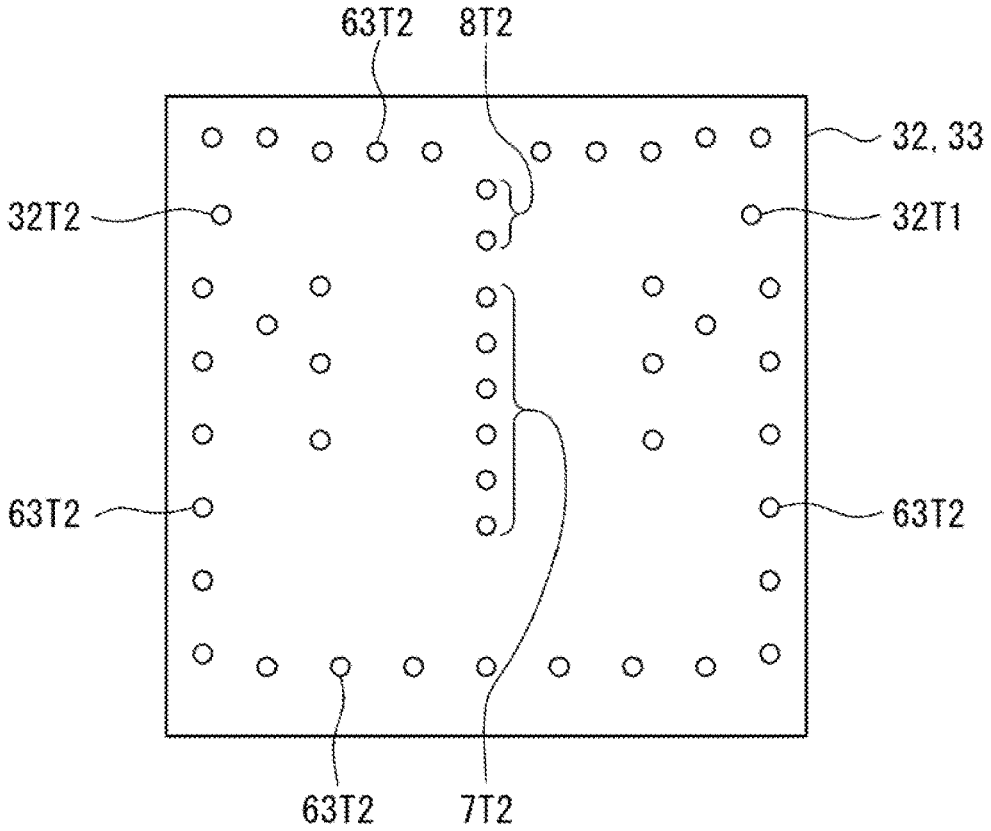
FIG. 4 is an explanatory diagram showing a patterned surface of each of a second and a third dielectric layer of the multilayer stack shown in FIG. 1.

FIG. 4 shows a patterned surface of each of the second and third dielectric layers 32 and 33. Through holes 32T1 and 32T2 are formed in each of the dielectric layers 32 and 33. The through holes 31T1 and 31T2 shown in FIG. 3 are respectively connected to the through holes 32T1 and 32T2 formed in the second dielectric layer 32.

Six through holes 7T2 constituting respective portions of the six through hole lines 7T are further formed in each of the dielectric layers 32 and 33. The six through holes 7T1 shown in FIG. 3 are respectively connected to the six through holes 7T2 formed in the second dielectric layer 32.

Further formed in each of the dielectric layers 32 and 33 are two through holes 8T2 constituting respective portions of the two through hole lines 8T. The two through holes 8T1 shown in FIG. 3 are respectively connected to the two through holes 8T2 formed in the second dielectric layer 32.

Further formed in each of the dielectric layers 32 and 33 are a plurality of through holes 63T2 constituting respective portions of the plurality of through hole lines 63T. All the through holes represented by circles in FIG. 4, except the through holes 32T1, 32T2, 7T2 and 8T2, are the through holes 63T2. The plurality of through holes 63T1 shown in FIG. 3 are respectively connected to the plurality of through holes 63T2 formed in the second dielectric layer 32.

In the dielectric layers 32 and 33, every vertically adjacent through holes denoted by the same reference signs are connected to each other.

Figure 5:
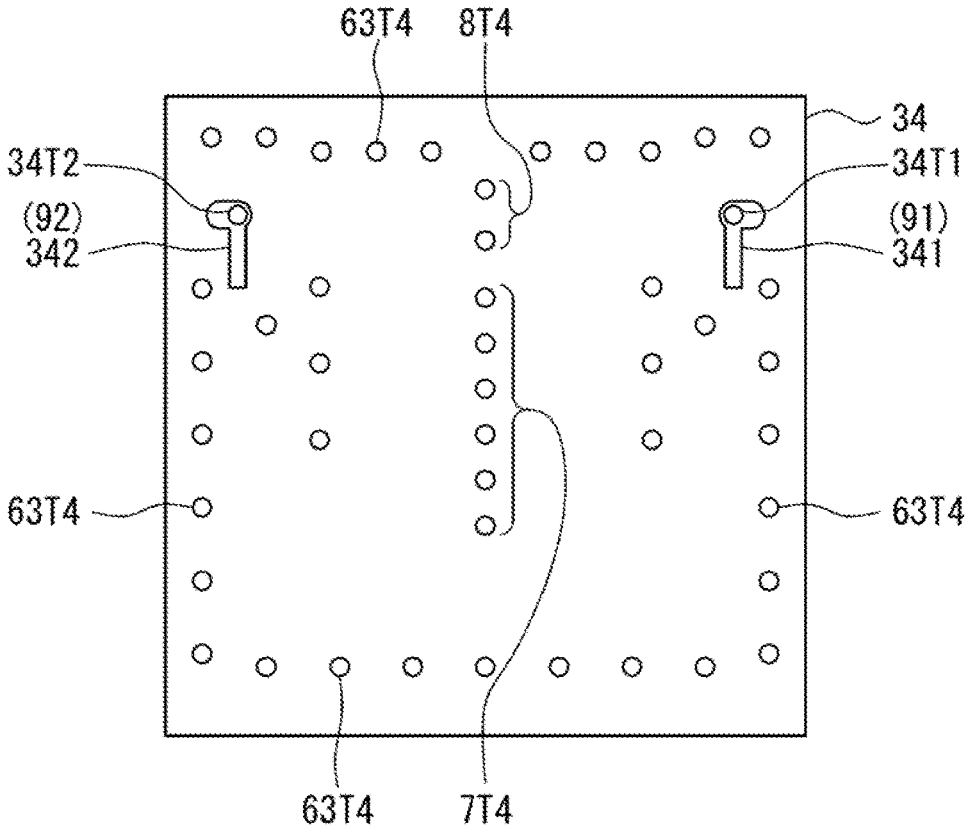
FIG. 5 is an explanatory diagram showing a patterned surface of a fourth dielectric layer of the multilayer stack shown in FIG. 1.

FIG. 5 shows a patterned surface of the fourth dielectric layer 34. A conductor layer 341 forming the line 91 and a conductor layer 342 forming the line 92 are formed on the patterned surface of the dielectric layer 34. Each of the conductor layers 341 and 342 has a first end and a second end opposite to each other. The through hole 32T1 formed in the third dielectric layer 33 is connected to a portion of the conductor layer 341 near the first end thereof. The through hole 32T2 formed in the third dielectric layer 33 is connected to a portion of the conductor layer 342 near the first end thereof. A portion of the conductor layer 341 near the second end thereof and a portion of the conductor layer 342 near the second end thereof are opposed to the conductor layer 313 shown in FIG. 3 with the dielectric layers 31, 32 and 33 interposed between the conductor layer 313 and each of the conductor layers 341 and 342.

In the dielectric layer 34, there are formed a through hole 34T1 connected to the portion of the conductor layer 341 near the first end thereof, and a through hole 34T2 connected to the portion of the conductor layer 342 near the first end thereof.

Further formed in the dielectric layer 34 are six through holes 7T4 constituting respective portions of the six through hole lines 7T. The six through holes 7T2 formed in the third dielectric layer 33 are respectively connected to the six through holes 7T4.

Further formed in the dielectric layer 34 are two through holes 8T4 constituting respective portions of the two through hole lines 8T. The two through holes 8T2 formed in the third dielectric layer 33 are respectively connected to the two through holes 8T4.

Further formed in the dielectric layer 34 are a plurality of through holes 63T4 constituting respective portions of the plurality of through hole lines 63T. All the through holes represented by circles in FIG. 5, except the through holes 34T1, 34T2, 7T4 and 8T4, are the through holes 63T4. The plurality of through holes 63T2 formed in the third dielectric layer 33 are respectively connected to the plurality of through holes 63T4.

Figure 6:
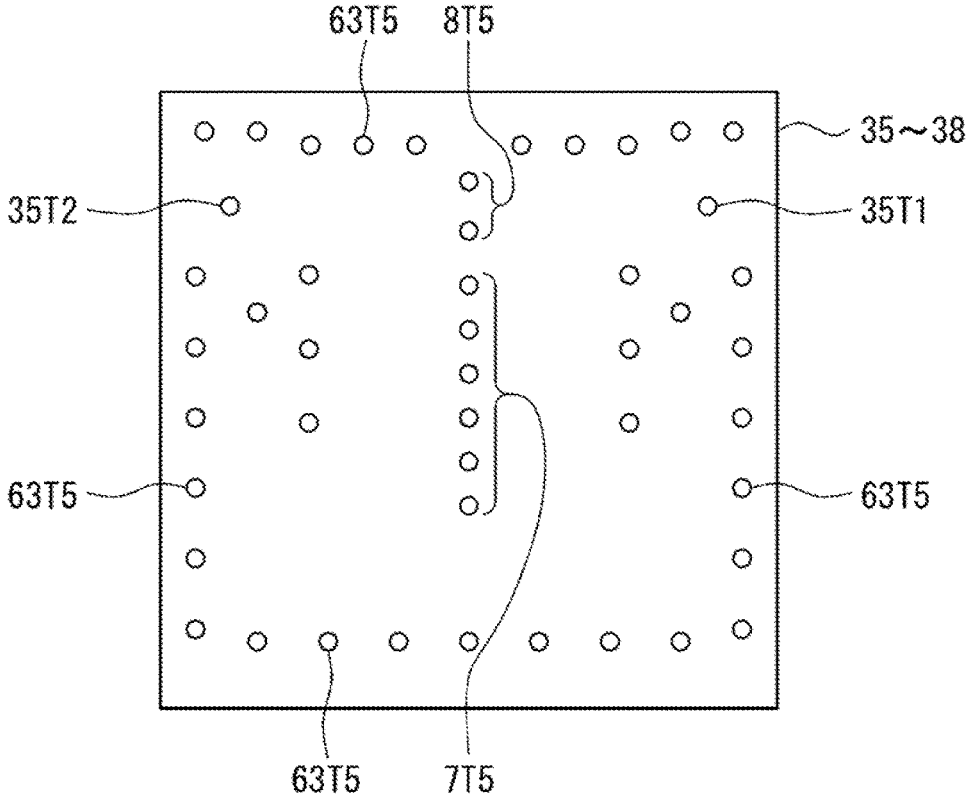
FIG. 6 is an explanatory diagram showing a patterned surface of each of a fifth to an eighth dielectric layer of the multilayer stack shown in FIG. 1.

FIG. 6 shows a patterned surface of each of the fifth to eighth dielectric layers 35 to 38. Through holes 35T1 and 35T2 are formed in each of the dielectric layers 35 to 38. The through holes 34T1 and 34T2 shown in FIG. 5 are respectively connected to the through holes 35T1 and 35T2 formed in the fifth dielectric layer 35.

Further formed in each of the dielectric layers 35 to 38 are six through holes 7T5 constituting respective portions of the six through hole lines 7T. The six through holes 7T4 shown in FIG. 5 are respectively connected to the six through holes 7T5 formed in the fifth dielectric layer 35.

In each of the dielectric layers 35 to 38, there are further formed two through holes 8T5 constituting respective portions of the two through hole lines 8T. The two through holes 8T4 shown in FIG. 5 are respectively connected to the two through holes 8T5 formed in the fifth dielectric layer 35.

Further, a plurality of through holes 63T5 constituting respective portions of the plurality of through hole lines 63T are formed in each of the dielectric layers 35 to 38. All the through holes represented by circles in FIG. 6, except the through holes 35T1, 35T2, 7T5 and 8T5, are the through holes 63T5. The plurality of through holes 63T4 shown in FIG. 5 are respectively connected to the plurality of through holes 63T5 formed in the fifth dielectric layer 35.

In the dielectric layers 35 to 38, every vertically adjacent through holes denoted by the same reference signs are connected to each other.

Figure 7:
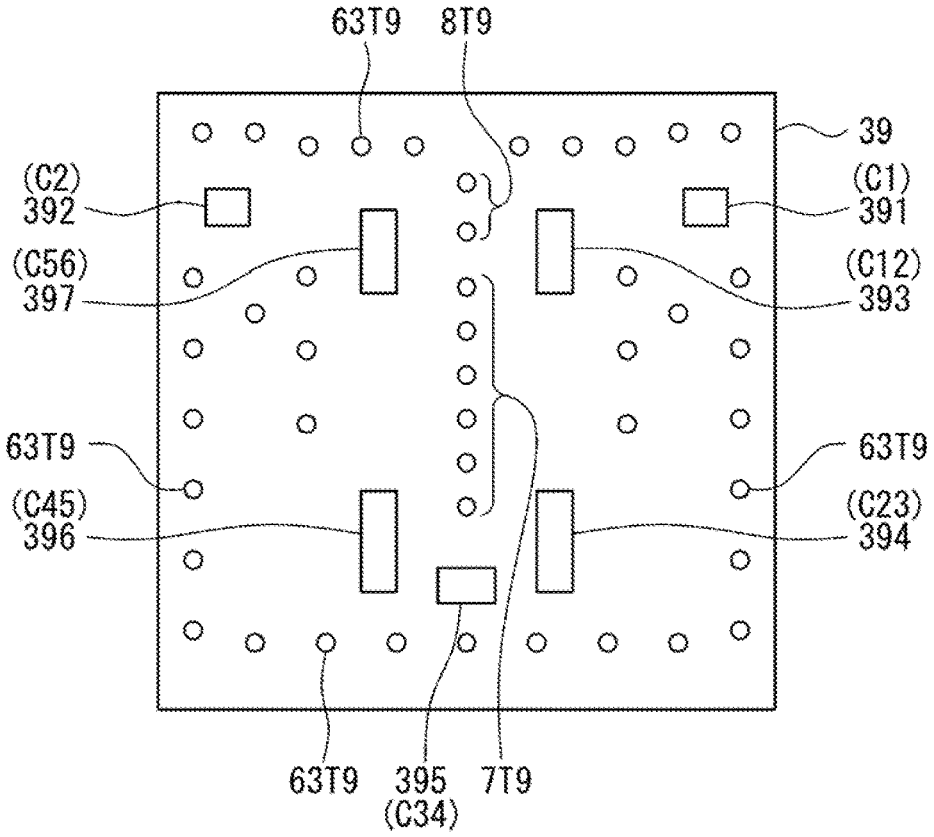
FIG. 7 is an explanatory diagram showing a patterned surface of a ninth dielectric layer of the multilayer stack shown in FIG. 1.

FIG. 7 shows a patterned surface of the ninth dielectric layer 39. On the patterned surface of the dielectric layer 39, there are formed a conductor layer 391 for forming the capacitor C1 shown in FIG. 2 and a conductor layer 392 for forming the capacitor C2 shown in FIG. 2. The through hole 35T1 formed in the eighth dielectric layer 38 is connected to the conductor layer 391. The through hole 35T2 formed in the eighth dielectric layer 38 is connected to the conductor layer 392.

On the patterned surface of the dielectric layer 39, there are further formed conductor layers 393, 394, 395, 396 and 397 for forming the capacitors C12, C23, C34, C45 and C56 shown in FIG. 2, respectively.

Further, six through holes 7T9 constituting respective portions of the six through hole lines 7T are formed in the dielectric layer 39. The six through holes 7T5 formed in the eighth dielectric layer 38 are respectively connected to the six through holes 7T9.

Further formed in the dielectric layer 39 are two through holes 8T9 constituting respective portions of the two through hole lines 8T. The two through holes 8T5 formed in the eighth dielectric layer 38 are respectively connected to the two through holes 8T9.

Further formed in the dielectric layer 39 are a plurality of through holes 63T9 constituting respective portions of the plurality of through hole lines 63T. All the through holes represented by circles in FIG. 7, except the through holes 7T9 and 8T9, are the through holes 63T9. The plurality of through holes 63T5 formed in the eighth dielectric layer 38 are respectively connected to the plurality of through holes 63T9.

Figure 8:
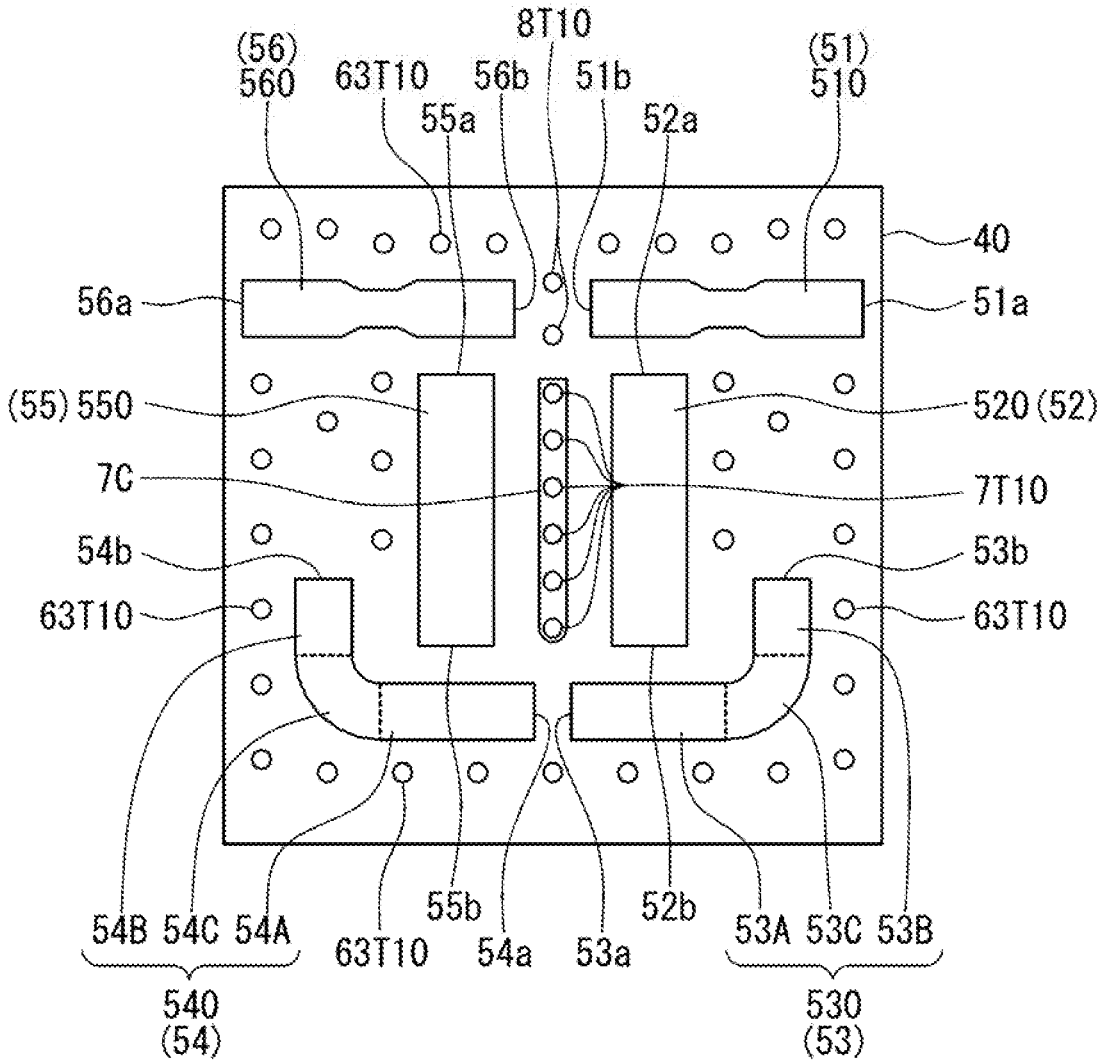
FIG. 8 is an explanatory diagram showing a patterned surface of a tenth dielectric layer of the multilayer stack shown in FIG. 1.
Figure 11:
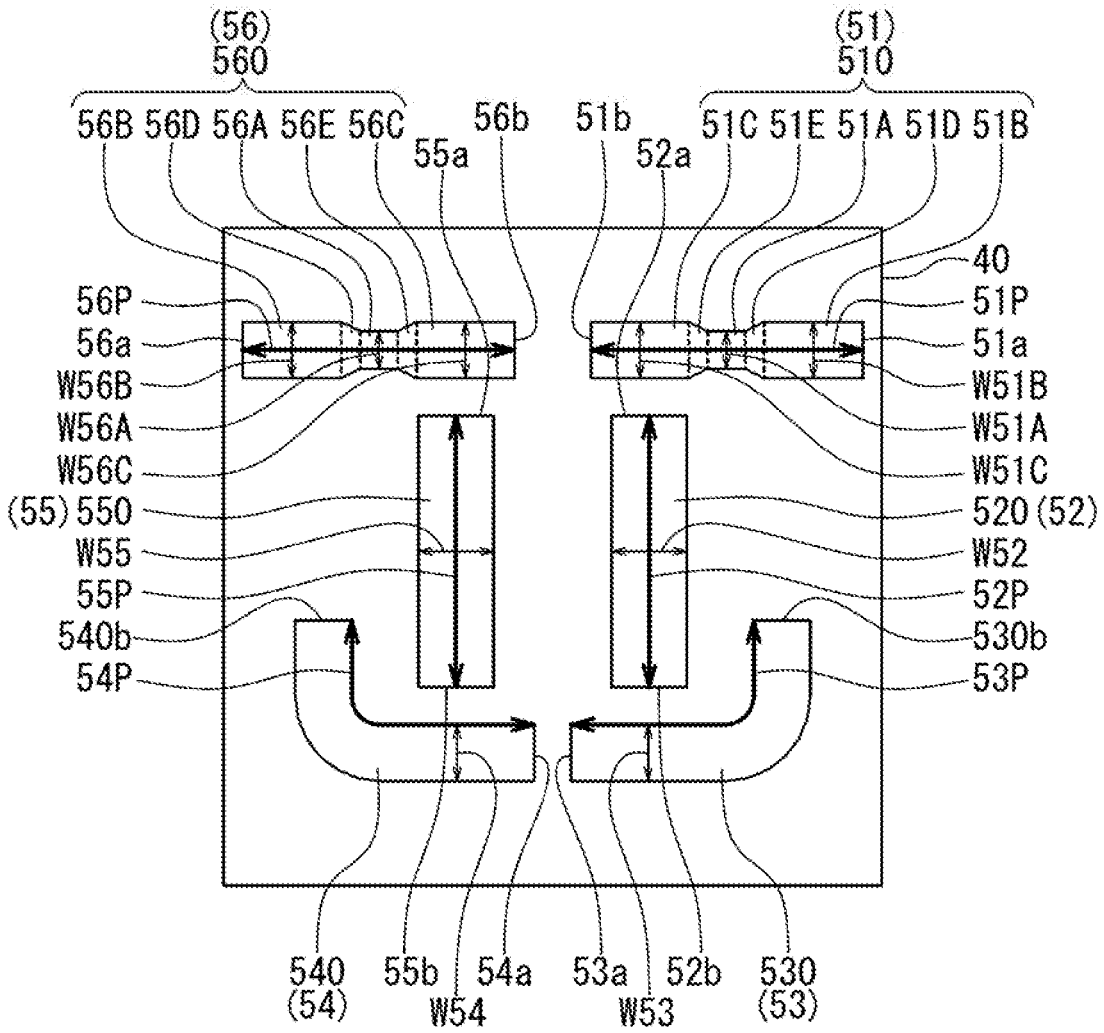
FIG. 11 is an explanatory diagram for explaining the configuration of a plurality of resonator conductor portions of the first embodiment of the invention.

FIG. 8 shows a patterned surface of the tenth dielectric layer 40. The resonator conductor portions 510, 520, 530, 540, 550 and 560 are formed on the patterned surface of the dielectric layer 40. Now, a detailed description will be given of the configuration of the resonator conductor portions 510, 520, 530, 540, 550 and 560 with reference to FIG. 8 and FIG. 11. FIG. 11 is an explanatory diagram for explaining the configuration of the resonator conductor portions 510, 520, 530, 540, 550 and 560.

The resonator conductor portion 510 has a first end 51*a* and a second end 51*b* which are opposite ends of the conductor line. The resonator conductor portion 520 has a first end 52*a* and a second end 52*b* which are opposite ends of the conductor line. The resonator conductor portion 530 has a first end 53*a* and a second end 53*b* which are opposite ends of the conductor line. The resonator conductor portion 540 has a first end 54*a* and a second end 54*b* which are opposite ends of the conductor line. The resonator conductor portion 550 has a first end 55*a* and a second end 55*b* which are opposite ends of the conductor line. The resonator conductor portion 560 has a first end 56*a* and a second end 56*b* which are opposite ends of the conductor line.

The thick arrows in FIG. 11 represent the shortest paths 51P, 52P, 53P, 54P, 55P and 56P connecting the respective first and second ends of the resonator conductor portions 510, 520, 530, 540, 550 and 560. Each shortest path corresponds to the shortest current path in the resonator conductor portion. For each resonator conductor portion, its dimension in a direction orthogonal to its shortest path will be referred to as a width.

The resonator conductor portions 510 and 560 each extend in the X direction. The resonator conductor portions 510 and 560 are arranged in such a positional relationship that a single straight line extending in the X direction intersects the resonator conductor portions 510 and 560. The second end 51*b* of the resonator conductor portion 510 and the second end 56*b* of the resonator conductor portion 560 are adjacent to each other and located at a predetermined distance from each other. The distance between the second end 51*b* and the second end 56*b* is sufficiently smaller than the length of each of the resonator conductor portions 510 and 560.

As shown in FIG. 11, the resonator conductor portion 510 includes a narrow portion 51A, a first wide portion 51B located between the narrow portion 51A and the first end 51*a*, a second wide portion 51C located between the narrow portion 51A and the second end 51*b*, and two coupling portions 51D and 51E. In the present embodiment, the first wide portion 51B includes the first end 51*a*, and the second wide portion 51C includes the second end 51*b*, in particular. The coupling portion 51D connects an end of the narrow portion 51A and an end of the first wide portion 51B opposite from the first end 51*a*. The coupling portion 51E connects the other end of the narrow portion 51A and an end of the second wide portion 51C opposite from the second end 51*b*. In FIG. 11 the boundary between the narrow portion 51A and the coupling portion 51D, the boundary between the narrow portion 51A and the coupling portion 51E, the boundary between the first wide portion 51B and the coupling portion 51D, and the boundary between the second wide portion 51C and the coupling portion 51E are shown in broken lines.

The narrow portion 51A has a width W51A, the first wide portion 51B has a width W51B, and the second wide portion 51C has a width W51C, each of the widths W51A, W51B and W51C being constant regardless of position in the X direction. The width W51A is smaller than the widths W51B and W51C. The coupling portions 51D and 51E vary in width depending on the position in the X direction. The width of the coupling portion 51D is equal to that of the narrow portion 51A at the boundary between the coupling portion 51D and the narrow portion 51A, and equal to that of the first wide portion 51B at the boundary between the coupling portion 51D and the first wide portion 51B. The width of the coupling portion 51E is equal to that of the narrow portion 51A at the boundary between the coupling portion 51E and the narrow portion 51A, and equal to that of the second wide portion 51C at the boundary between the coupling portion 51E and the second wide portion 51C.

As shown in FIG. 11, the resonator conductor portion 560 includes a narrow portion 56A, a first wide portion 56B located between the narrow portion 56A and the first end 56*a*, a second wide portion 56C located between the narrow portion 56A and the second end 56*b*, and two coupling portions 56D and 56E. In the present embodiment, the first wide portion 56B includes the first end 56*a*, and the second wide portion 56C includes the second end 56*b*, in particular. The coupling portion 56D connects an end of the narrow portion 56A and an end of the first wide portion 56B opposite from the first end 56*a*. The coupling portion 56E connects the other end of the narrow portion 56A and an end of the second wide portion 56C opposite from the second end 56*b*. In FIG. 11 the boundary between the narrow portion 56A and the coupling portion 56D, the boundary between the narrow portion 56A and the coupling portion 56E, the boundary between the first wide portion 56B and the coupling portion 56D, and the boundary between the second wide portion 56C and the coupling portion 56E are shown in broken lines.

The narrow portion 56A has a width W56A, the first wide portion 56B has a width W56B, and the second wide portion 56C has a width W56C, each of the widths W56A, W56B and W56C being constant regardless of position in the X direction. The width W56A is smaller than the widths W56B and W56C. The coupling portions 56D and 56E vary in width depending on the position in the X direction. The width of the coupling portion 56D is equal to that of the narrow portion 56A at the boundary between the coupling portion 56D and the narrow portion 56A, and equal to that of the first wide portion 56B at the boundary between the coupling portion 56D and the first wide portion 56B. The width of the coupling portion 56E is equal to that of the narrow portion 56A at the boundary between the coupling portion 56E and the narrow portion 56A, and equal to that of the second wide portion 56C at the boundary between the coupling portion 56E and the second wide portion 56C.

The resonator conductor portions 520 and 550 each extend in the Y direction. The resonator conductor portions 520 and 550 are adjacent to each other in the X direction and located at a predetermined distance from each other. The distance between the resonator conductor portions 520 and 550 is sufficiently smaller than the length of each of the resonator conductor portions 520 and 550.

The resonator conductor portion 520 has a width W52, the width W52 being constant between the first end 52*a* and the second end 52*b*. The resonator conductor portion 550 has a width W55, the width W55 being constant between the first end 55*a* and the second end 55*b*.

The first end 52*a* of the resonator conductor portion 520 is located near the second end 51*b* of the resonator conductor portion 510. The first end 55*a* of the resonator conductor portion 550 is located near the second end 56*b* of the resonator conductor portion 560.

As shown in FIG. 8, the resonator conductor portion 530 includes a first portion 53A, a second portion 53B, and a third portion 53C. The first portion 53A includes the first end 53*a*, and the second portion 53B includes the second end 53*b*. The first portion 53A extends in the X direction, and the second portion 53B extends in the Y direction. The third portion 53C connects an end of the first portion 53A opposite from the first end 53*a* and an end of the second portion 53B opposite from the second end 53*b*. In FIG. 8 the boundary between the first portion 53A and the third portion 53C and the boundary between the second portion 53B and the third portion 53C are shown in broken lines. The first end 53*a* is located near the second end 52*b* of the resonator conductor portion 520. The resonator conductor portion 530 has a width W53, the width W53 being constant between the first end 53*a* and the second end 53*b*.

As shown in FIG. 8, the resonator conductor portion 540 includes a first portion 54A, a second portion 54B, and a third portion 54C. The first portion 54A includes the first end 54*a*, and the second portion 54B includes the second end 54*b*. The first portion 54A extends in the X direction, and the second portion 54B extends in the Y direction. The third portion 54C connects an end of the first portion 54A opposite from the first end 54*a* and an end of the second portion 54B opposite from the second end 54*b*. In FIG. 8 the boundary between the first portion 54A and the third portion 54C and the boundary between the second portion 54B and the third portion 54C are shown in broken lines. The first end 54*a* is located near the second end 55*b* of the resonator conductor portion 550. The resonator conductor portion 540 has a width W54, the width W54 being constant between the first end 54*a* and the second end 54*b*.

The first end 53*a* of the resonator conductor portion 530 and the first end 54*a* of the resonator conductor portion 540 are adjacent to each other and located at a predetermined distance from each other.

Now, components formed on/in the dielectric layer 40 other than the resonator conductor portions 510, 520, 530, 540, 550 and 560 will be described with reference to FIG. 8. A conductor layer 7C forming a portion of the partition 7 is formed on the patterned surface of the dielectric layer 40. The conductor layer 7C is located between the resonator conductor portions 520 and 550 and extends in the Y direction.

Further, six through holes 7T10 constituting respective portions of the six through hole lines 7T are formed in the dielectric layer 40. The six through holes 7T10 are connected to the conductor layer 7C. The six through holes 7T9 shown in FIG. 7 are respectively connected to the six through holes 7T10.

Further, two through holes 8T10 constituting respective portions of the two through hole lines 8T are formed in the dielectric layer 40. The two through holes 8T9 shown in FIG. 7 are respectively connected to the two through holes 8T10.

Further formed in the dielectric layer 40 are a plurality of through holes 63T10 constituting respective portions of the plurality of through hole lines 63T. All the through holes represented by circles in FIG. 8, except the through holes 7T10 and 8T10, are the through holes 63T10. The plurality of through holes 63T9 shown in FIG. 7 are respectively connected to the plurality of through holes 63T10.

Figure 9:
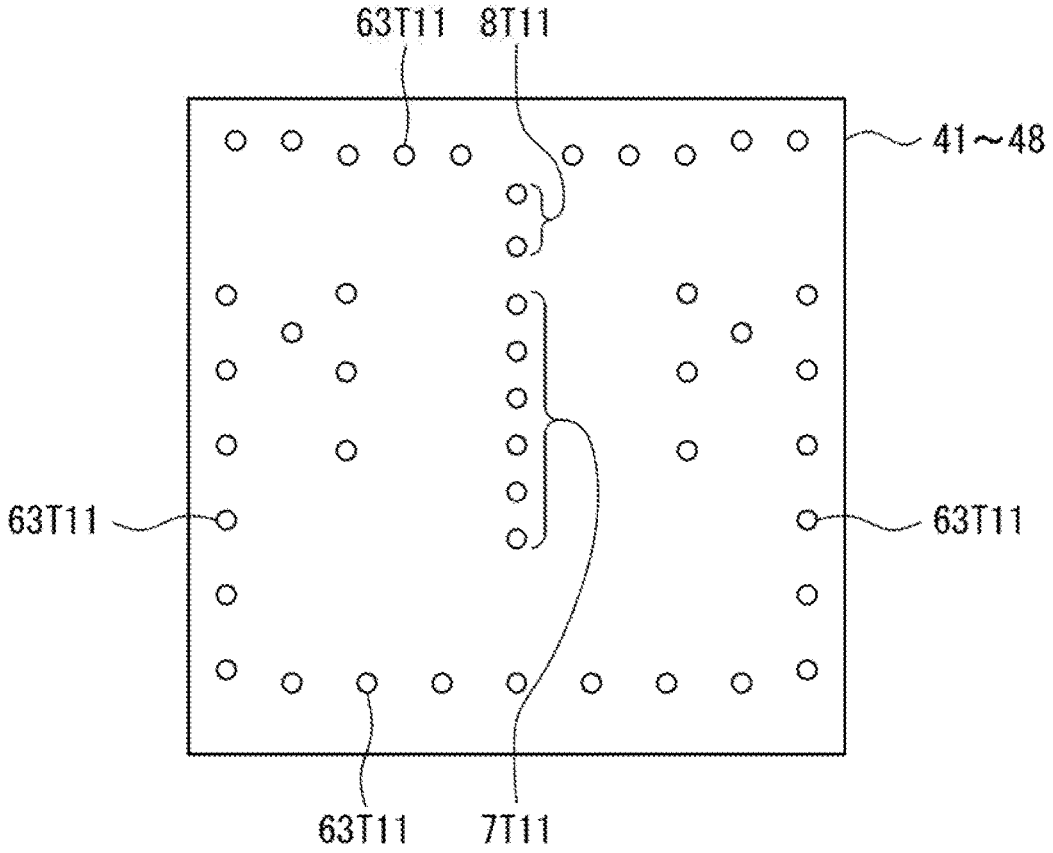
FIG. 9 is an explanatory diagram showing a patterned surface of each of an eleventh to an eighteenth dielectric layer of the multilayer stack shown in FIG. 1.

FIG. 9 shows a patterned surface of each of the eleventh to eighteenth dielectric layers 41 to 48. Six through holes 7T11 constituting respective portions of the six through hole lines 7T are formed in each of the dielectric layers 41 to 48. The six through holes 7T10 shown in FIG. 8 are respectively connected to the six through holes 7T11 formed in the eleventh dielectric layer 41.

In each of the dielectric layers 41 to 48, there are further formed two through holes 8T11 constituting respective portions of the two through hole lines 8T. The two through holes 8T10 shown in FIG. 8 are respectively connected to the two through holes 8T11 formed in the eleventh dielectric layer 41.

Further, a plurality of through holes 63T11 constituting respective portions of the plurality of through hole lines 63T are formed in each of the dielectric layers 41 to 48. All the through holes represented by circles in FIG. 9, except the through holes 7T11 and 8T11, are the through holes 63T11. The plurality of through holes 63T10 shown in FIG. 8 are respectively connected to the plurality of through holes 63T11 formed in the eleventh dielectric layer 41.

In the dielectric layers 41 to 48, every vertically adjacent through holes denoted by the same reference signs are connected to each other.

Figure 10:
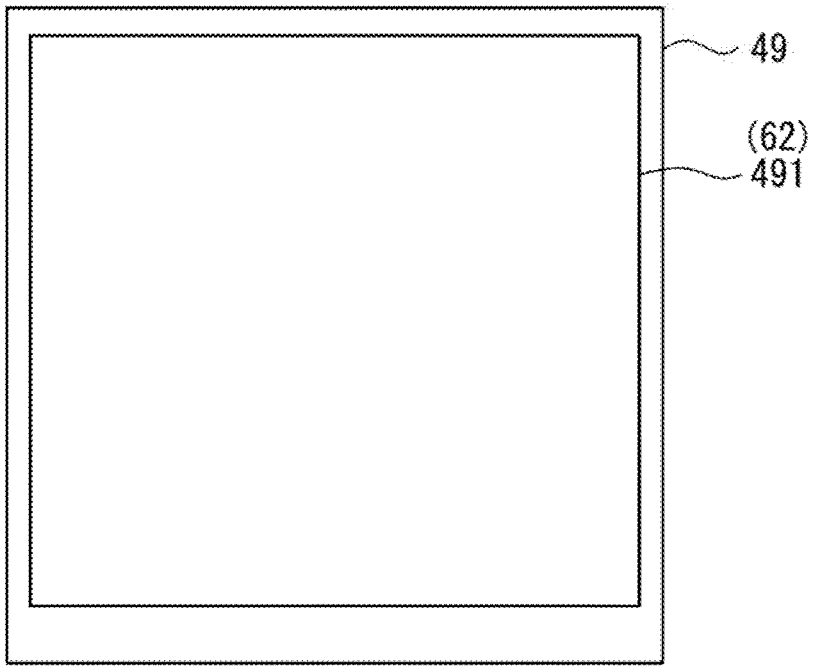
FIG. 10 is an explanatory diagram showing a patterned surface of a nineteenth dielectric layer of the multilayer stack shown in FIG. 1.

FIG. 10 shows a patterned surface of the nineteenth dielectric layer 49. The second conductor layer 491 forming the second portion 62 of the shield 6 is formed on the patterned surface of the dielectric layer 49. The through holes 7T11, 8T11 and 63T11 formed in the eighteenth dielectric layer 48 are connected to the second conductor layer 491.

The band-pass filter 1 according to the present embodiment is formed by stacking the first to nineteenth dielectric layers 31 to 49 such that the patterned surface of the first dielectric layer 31 also serves as the first end face 2A of the main body 2. A surface of the nineteenth dielectric layer 49 opposite from the patterned surface serves as the second end face 2B of the main body 2. The first to nineteenth dielectric layers 31 to 49 constitute the multilayer stack 20.

The respective resonator conductor portions 510, 520, 530, 540, 550 and 560 of the resonators 51 to 56 are located at the same position in the Z direction within the multilayer stack 20.

The conductor layer 311 forming the first input/output port 3 is connected to the conductor layer 391 shown in FIG. 7 via the through holes 31T1 and 32T1, the conductor layer 341, and the through holes 34T1 and 35T1. The conductor layer 391 is opposed to a portion of the resonator conductor portion 510 near the first end 51*a* shown in FIG. 8, with the dielectric layer 39 interposed between the conductor layer 391 and the resonator conductor portion 510. The capacitor C1 shown in FIG. 2 is composed of the conductor layer 391, the resonator conductor portion 510, and the dielectric layer 39 interposed between the conductor layer 391 and the resonator conductor portion 510.

The conductor layer 312 forming the second input/output port 4 is connected to the conductor layer 392 shown in FIG. 7 via the through holes 31T2 and 32T2, the conductor layer 342 and the through holes 34T2 and 35T2. The conductor layer 392 is opposed to a portion of the resonator conductor portion 560 near the first end 56*a* shown in FIG. 8, with the dielectric layer 39 interposed between the conductor layer 392 and the resonator conductor portion 560. The capacitor C2 shown in FIG. 2 is composed of the conductor layer 392, the resonator conductor portion 560, and the dielectric layer 39 interposed between the conductor layer 392 and the resonator conductor portion 560.

The conductor layer 393 shown in FIG. 7 is opposed to a portion of the resonator conductor portion 510 near the second end 51*b* and to a portion of the resonator conductor portion 520 near the first end 52*a*, with the dielectric layer 39 interposed between the conductor layer 393 and each of the resonator conductor portions 510 and 520. The capacitor C12 shown in FIG. 2 is composed of the conductor layer 393, the resonator conductor portions 510 and 520, and the dielectric layer 39 interposed between the conductor layer 393 and the resonator conductor portions 510 and 520.

The conductor layer 394 shown in FIG. 7 is opposed to a portion of the resonator conductor portion 520 near the second end 52*b* and to a portion of the resonator conductor portion 530 near the first end 53*a*, with the dielectric layer 39 interposed between the conductor layer 394 and each of the resonator conductor portions 520 and 530. The capacitor C23 shown in FIG. 2 is composed of the conductor layer 394, the resonator conductor portions 520 and 530, and the dielectric layer 39 interposed between the conductor layer 394 and the resonator conductor portions 520 and 530.

The conductor layer 395 shown in FIG. 7 is opposed to a portion of the resonator conductor portion 530 near the first end 53*a* and to a portion of the resonator conductor portion 540 near the first end 54*a*, with the dielectric layer 39 interposed between the conductor layer 395 and each of the resonator conductor portions 530 and 540. The capacitor C34 shown in FIG. 2 is composed of the conductor layer 395, the resonator conductor portions 530 and 540, and the dielectric layer 39 interposed between the conductor layer 395 and the resonator conductor portions 530 and 540.

The conductor layer 396 shown in FIG. 7 is opposed to a portion of the resonator conductor portion 540 near the first end 54*a* and to a portion of the resonator conductor portion 550 near the second end 55*b*, with the dielectric layer 39 interposed between the conductor layer 396 and each of the resonator conductor portions 540 and 550. The capacitor C45 shown in FIG. 2 is composed of the conductor layer 396, the resonator conductor portions 540 and 550, and the dielectric layer 39 interposed between the conductor layer 396 and the resonator conductor portions 540 and 550.

The conductor layer 397 shown in FIG. 7 is opposed to a portion of the resonator conductor portion 550 near the first end 55*a* and to a portion of the resonator conductor portion 560 near the second end 56*b*, with the dielectric layer 39 interposed between the conductor layer 397 and each of the resonator conductor portions 550 and 560. The capacitor C56 shown in FIG. 2 is composed of the conductor layer 397, the resonator conductor portions 550 and 560, and the dielectric layer 39 interposed between the conductor layer 397 and the resonator conductor portions 550 and 560.

Each of the six through hole lines 7T of the partition 7 is formed by connecting the through holes 7T1, 7T2, 7T4, 7T5, 7T9, 7T10 and 7T11 in series in the Z direction.

In the example shown in FIG. 3 to FIG. 10, the partition 7 extends to pass between the resonator conductor portion 520 and the resonator conductor portion 550, and is in contact with the first portion 61 and the second portion 62.

Each of the two through hole lines 8T of the coupling adjustment section 8 is formed by connecting the through holes 8T1, 8T2, 8T4, 8T5, 8T9, 8T10 and 8T11 in series in the Z direction.

Each of the plurality of through hole lines 63T of the connecting portion 63 is formed by connecting the through holes 63T1, 63T2, 63T4, 63T5, 63T9, 63T10 and 63T11 in series in the Z direction.

The band-pass filter 1 according to the present embodiment is designed and configured to have a passband in a quasi-millimeter wave band of 10 to 30 GHz or a millimeter wave band of 30 to 300 GHz, for example. The band-pass filter 1 includes N resonators located between the first input/output port 3 and the second input/output port 4 in circuit configuration. The N resonators are configured so that electromagnetic coupling is established between every two of the resonators adjacent to each other in circuit configuration.

The features of the band-pass filter 1 according to the present embodiment will now be described. Of the N resonators included in the band-pass filter 1, one that is i-th closest to the first input/output port 3 in circuit configuration will hereinafter be referred to as an i-th stage resonator. When N is an even number, an N/2-th stage resonator and an N/2+1-th stage resonator will be referred to as middle resonators. When N is an odd number, an (N+1)/2-th stage resonator will be referred to as a middle resonator. In the present embodiment, specifically, N is 6. Thus, in the embodiment the third stage resonator 53 and the fourth stage resonator 54 are the middle resonators.

In the present embodiment, the N resonators include at least a pair of first and second resonators, the first and second resonators being non-adjacent to each other in circuit configuration, and a third resonator located between the first and second resonators in circuit configuration.

The first resonator is an i-th stage resonator where i has a value smaller than (N+1)/2. This means that the first resonator is closer to the first input/output port 3 than the middle resonators in circuit configuration.

The second resonator is an i-th stage resonator where i has a value greater than (N+1)/2. This means that the second resonator is closer to the second input/output port 4 than the middle resonators in circuit configuration.

The first resonator includes a first resonator conductor portion formed of a conductor line. The second resonator includes a second resonator conductor portion formed of a conductor line. The third resonator includes a third resonator conductor portion formed of a conductor line. Each of the first to third resonator conductor portions has a first end and a second end which are opposite ends of the conductor line.

Each of the first and second resonator conductor portions includes a narrow portion, a first wide portion located between the narrow portion and the first end, and a second wide portion located between the narrow portion and the second end. The narrow portion is smaller in width than the first and second wide portions, the width being a dimension in a direction orthogonal to the shortest path connecting the first end and the second end. Each of the first and second resonators is lower in unloaded Q than the third resonator. Each of the first and second resonator conductor portions may be smaller in length of the shortest path than the third resonator conductor portion.

The above-described resonator with the resonator conductor portion including the narrow portion, the first wide portion and the second wide portion is a kind of SIR. Given the same resonant frequency, forming a resonator as an SIR results in a lower unloaded Q while enabling reduction in length of the shortest path of the resonator conductor portion, as compared to a case where the resonator is not configured as an SIR.

In the present embodiment, the first resonator is the first stage resonator 51, and the second resonator is the N-th stage resonator, i.e., the sixth stage resonator 56. Further, in the present embodiment there are four third resonators. Specifically, the second to fifth stage resonators 52 to 55 are the third resonators. The resonator conductor portion 510 corresponds to the first resonator conductor portion. The resonator conductor portion 560 corresponds to the second resonator conductor portion. The resonator conductor portions 520, 530, 540 and 550 each correspond to the third resonator conductor portion. The resonators 51 and 56 are each lower in unloaded Q than the resonators 52, 53, 54 and 55.

As has been described with reference to FIG. 11, the resonator conductor portion 510 includes the narrow portion 51A, the first wide portion 51B, and the second wide portion 51C. The resonator conductor portion 560 includes the narrow portion 56A, the first wide portion 56B, and the second wide portion 56C. The resonators 51 and 56 are SIRs.

Each of the resonator conductor portions 520, 530, 540 and 550 includes no portion having a width smaller than the width at each of the first end and the second end. In the present embodiment, in particular, each of the resonator conductor portions 520, 530, 540 and 550 has a width constant between the first end and the second end. None of the resonators 52 to 55 are SIRs.

The length of the shortest path of the resonator conductor portion of each resonator depends on the resonant frequency of the resonator. The resonators 51 to 56 are designed so that their resonant frequencies are equal to or close to the center frequency of the passband of the band-pass filter 1. However, the resonant frequencies of the resonators 51 to 56 are not necessarily equal to each other. Thus, the shortest paths 51P and 56P of the resonator conductor portions 510 and 560 of the resonators 51 and 56, which are SIRs, are not necessarily smaller in length than the shortest paths 52P, 53P, 54P and 55P of the resonator conductor portions 520, 530, 540 and 550 of the resonators 52 to 55, none of which are SIRs.

In the present embodiment, in particular, the shortest paths 51P and 56P of the resonator conductor portions 510 and 560 are each smaller in length than the shortest paths 53P and 54P of the resonator conductor portions 530 and 540. The length of each of the shortest paths 52P and 55P of the resonator conductor portion 520 and 550 is equal or almost equal to the length of each of the shortest paths 51P and 56P.

Now, the unloaded Q of an i-th stage resonator will be denoted by the symbol Qui, and the normalized element value of the i-th stage resonator will be denoted by the symbol gi. The insertion loss at the center frequency of the passband of the band-pass filter 1 based on the unloaded Qs of the N resonators is proportional to the sum total of the values of gi/Qui for the N resonators.

If an i-th stage resonator is configured as an SIR, the i-th stage resonator has a lower Qui than in the case where it is formed of a conductor line of constant width. This results in an increase in insertion loss. If all of the N resonators are configured as SIRs, an excessively high insertion loss would result. In view of this, in the present embodiment, only some, not all, of the N resonators are configured as SIRs.

The normalized element value gi of a band-pass filter including N resonators depends on the characteristics of the filter; however, typically, the lesser the value of i than (N+1)/2, or the greater the value of i above (N+1)/2, the smaller is the normalized element value gi. For example, if the N resonators have the same resonant frequency and the band-pass filter has a maximally-flat characteristic, gi is expressed as 2 sin((2i−1)π/2N). In the present embodiment, a resonator that is located closer to the first input/output port 3 or the second input/output port 4 in circuit configuration is smaller in normalized element value gi and lower in the ratio of the amount of change in insertion loss to the amount of change in Qui.

Therefore, in the case of configuring only some of the resonators as SIRs, an increase in insertion loss can be reduced by selecting a resonator located closer to the first input/output port 3 or the second input/output port 4 to be an SIR, rather than a middle resonator or a resonator located near the middle resonator in circuit configuration.

In view of the above, in the present embodiment, only the first stage resonator 51 and the sixth stage resonator 56, which are the closest of all the N resonators to the first input/output port 3 and the second input/output port 4 in circuit configuration, respectively, are configured as SIRs.

According to the present embodiment, since the resonators 51 and 56 configured as SIRs can achieve size reduction, it becomes possible to miniaturize the band-pass filter 1. Further, according to the present embodiment, since only the resonators 51 and 56 are configured as SIRs, it is possible to reduce an increase in insertion loss of the band-pass filter 1.

An example of unloaded Qs of the resonators 51 to 56 of the present embodiment will now be shown. In this example, the first and sixth stage resonators 51 and 56 have an unloaded Q of 250. The second and fifth stage resonators 52 and 55 have an unloaded Q of 288. The third and fourth stage resonators 53 and 54 have an unloaded Q of 253. Thus, in this example, each of the first and sixth stage resonators 51 and 56 is lower in unloaded Q than the second to fifth stage resonators 52 to 55.

Next, a description will be given of the results of a simulation on the band-pass filter 1 according to the present embodiment. The simulation determined the frequency response of insertion loss for each of first to third models of the band-pass filter 1. The first to third models have different combinations of unloaded Qs of the resonators 51 to 56.

In the first model, all the resonators 51 to 56 have an unloaded Q of 200. In the second model, the resonators 51 and 56 have an unloaded Q of 100, and the resonators 52 to 55 have an unloaded Q of 200. In the third model, the resonators 52 and 55 have an unloaded Q of 100, and the resonators 51, 53, 54 and 56 have an unloaded Q of 200.

Figure 12:
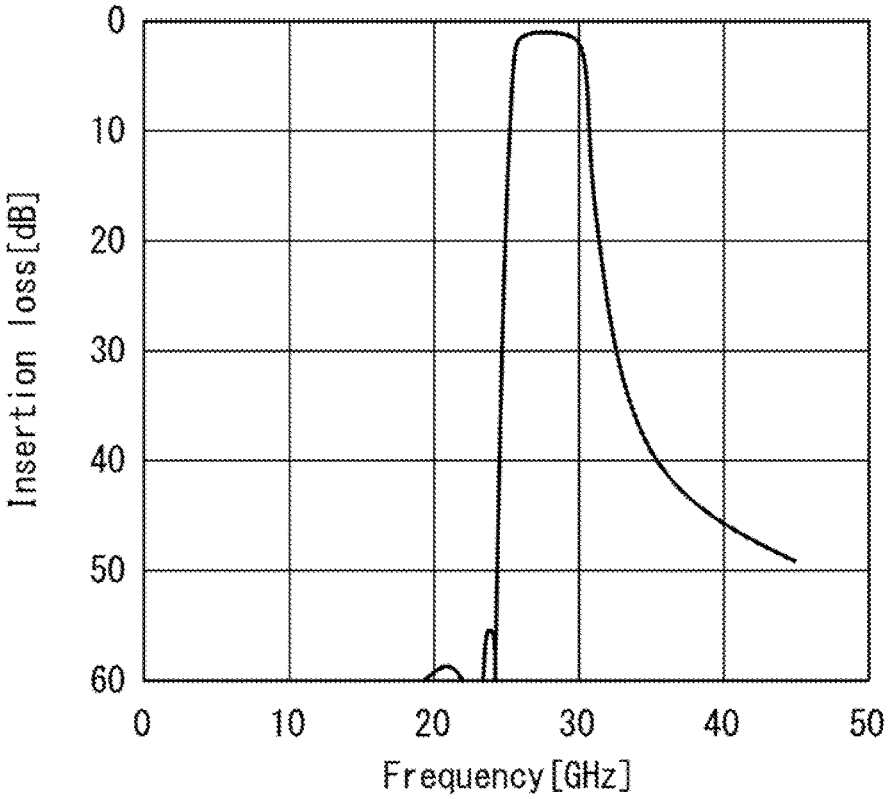
FIG. 12 is a characteristic chart showing the results of a simulation on the band-pass filter according to the first embodiment of the invention.
Figure 13:
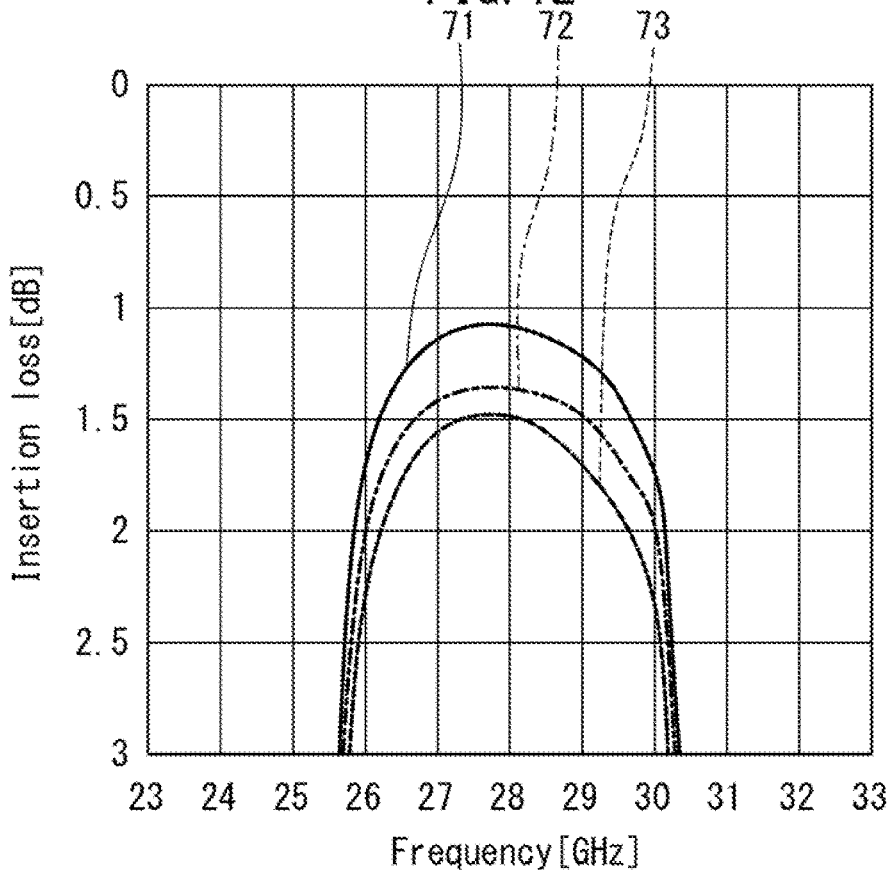
FIG. 13 is a characteristic chart showing a part of FIG. 12 on an enlarged scale.

FIG. 12 shows the frequency response of the insertion loss of the first to third models. FIG. 13 shows a part of FIG. 12 on an enlarged scale. In FIGS. 12 and 13 the horizontal axis represents frequency, and the vertical axis represents insertion loss. In FIG. 13 the curves designated by the reference numerals 71, 72 and 73 represent the characteristics of the first, second and third models, respectively.

The center frequency of the passband of each of the first to third models is approximately 28 GHz. As shown in FIG. 13, the second and third models each exhibit a larger insertion loss at the center frequency of the passband as compared to the first model. When the second model and the third model are compared in terms of insertion loss at the center frequency of the passband, the second model is smaller. This indicates that a resonator that is located closer to the first input/output port 3 or the second input/output port 4 in circuit configuration is lower in the ratio of the amount of change in insertion loss to the amount of change in unloaded Q. Therefore, as described above, in the case of configuring only some of the resonators as SIRs, an increase in insertion loss can be reduced by selecting a resonator located closer to the first input/output port 3 or the second input/output port 4 to be an SIR, rather than a middle resonator or a resonator located near the middle resonator in circuit configuration.

By configuring a resonator as an SIR, it becomes possible to increase the ratio of a higher-order mode resonant frequency to a fundamental mode resonant frequency. According to the present embodiment, configuring the resonators 51 and 56 as SIRs allows the higher-order mode resonant frequencies of the resonators 51 and 56 to be higher. The present embodiment thereby makes it possible to prevent the attenuation characteristic of the band-pass filter 1 in a frequency region higher than the passband from being degraded due to the higher-order mode.

Figure 14:
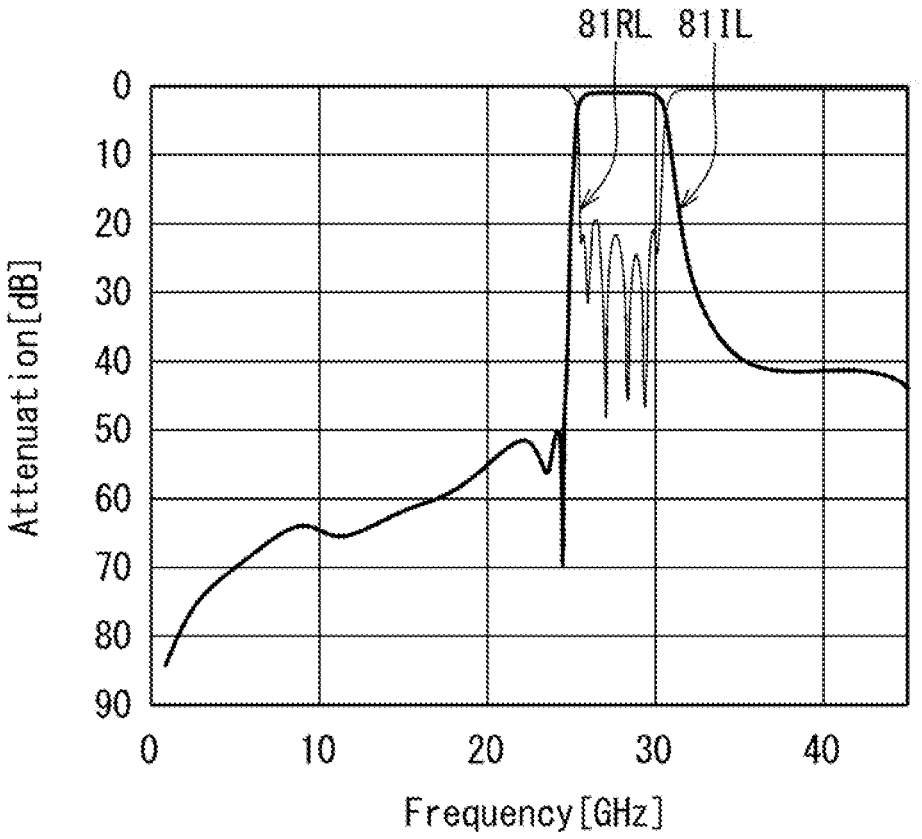
FIG. 14 is a characteristic chart showing an example of frequency responses of insertion loss and return loss of the band-pass filter according to the first embodiment of the invention.

FIG. 14 shows an example of frequency responses of the insertion loss and return loss of the band-pass filter 1 according to the present embodiment. Hereinafter, the values of insertion loss and return loss will collectively be referred to as attenuation. In FIG. 14 the horizontal axis represents frequency, and the vertical axis represents attenuation. In FIG. 14 the curve designated by the reference symbol 811L represents the frequency response of the insertion loss, and the curve designated by the reference symbol 81RL represents the frequency response of the return loss.

Second Embodiment

Figure 15:
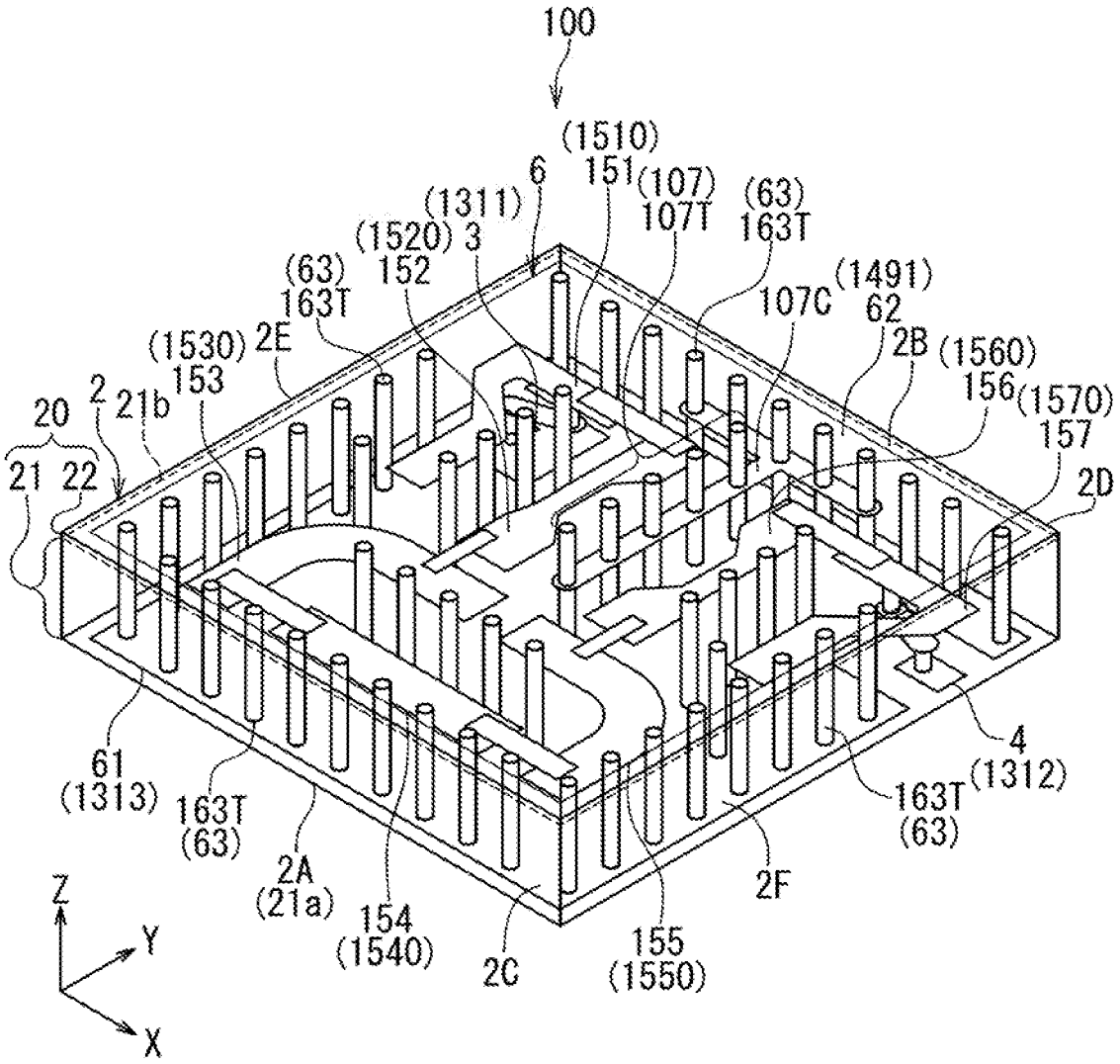
FIG. 15 is a perspective view showing the structure of a band-pass filter according to a second embodiment of the invention.
Figure 16:
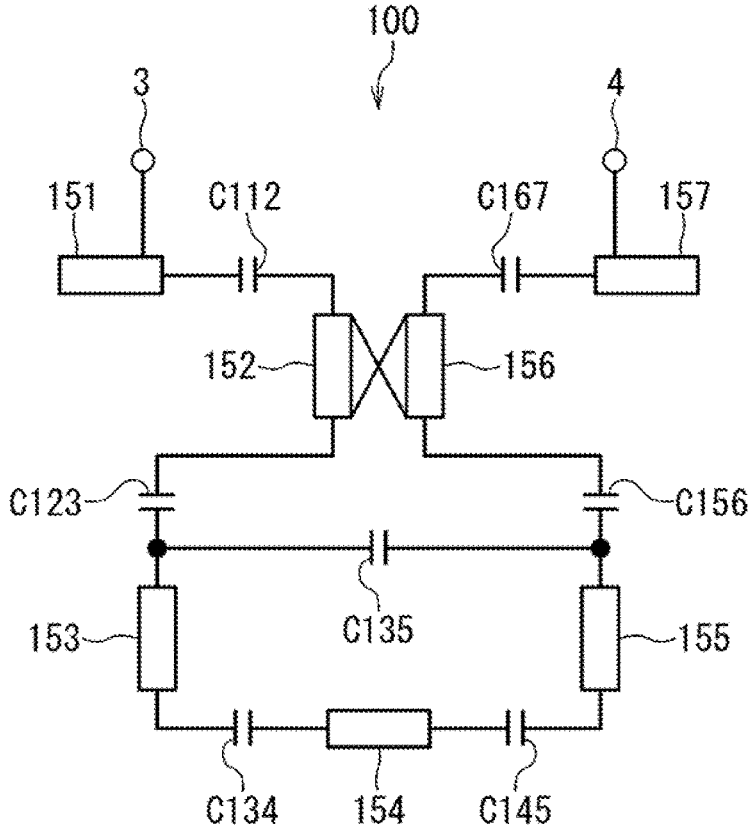
FIG. 16 is a circuit diagram showing the circuit configuration of the band-pass filter according to the second embodiment of the invention.

A second embodiment of the present invention will now be described. First, the configuration of a band-pass filter according to the second embodiment will be described with reference to FIG. 15 and FIG. 16. FIG. 15 is a perspective view showing the structure of the band-pass filter according to the second embodiment. FIG. 16 is a circuit diagram showing the circuit configuration of the band-pass filter according to the second embodiment.

The band-pass filter 100 according to the present embodiment includes the main body 2, the first input/output port 3, the second input/output port 4, N resonators, the shield 6, and a partition 107. The main body 2 includes the multilayer stack 20.

The N resonators are located between the first input/output port 3 and the second input/output port 4 in circuit configuration. In the present embodiment, N is 7, and the N resonators are seven resonators 151, 152, 153, 154, 155, 156 and 157. The seven resonators 151, 152, 153, 154, 155, 156 and 157 are arranged in this order, from closest to farthest, from the first input/output port 3 in circuit configuration. The resonators 151 to 157 are configured so that the resonators 151 and 152 are adjacent to each other in circuit configuration and are electromagnetically coupled to each other, the resonators 152 and 153 are adjacent to each other in circuit configuration and are electromagnetically coupled to each other, the resonators 153 and 154 are adjacent to each other in circuit configuration and are electromagnetically coupled to each other, the resonators 154 and 155 are adjacent to each other in circuit configuration and are electromagnetically coupled to each other, the resonators 155 and 156 are adjacent to each other in circuit configuration and are electromagnetically coupled to each other, and the resonators 156 and 157 are adjacent to each other in circuit configuration and are electromagnetically coupled to each other. In the present embodiment, the electromagnetic coupling between every two of the resonators adjacent to each other in circuit configuration is specifically capacitive coupling. In the present embodiment, each of the resonators 151 to 157 is a resonator with open ends, and also a half-wave resonator.

The first portion 61, the second portion 62 and the connecting portion 63 of the shield 6 are arranged to surround the seven resonators 151 to 157. The first portion 61 is formed of a first conductor layer 1313 disposed on the first end face 21*a* of the main portion 21 of the multilayer stack 20. The second portion 62 is formed of a second conductor layer 1491 disposed on the second end face 21*b* of the main portion 21 of the multilayer stack 20.

The band-pass filter 100 includes a capacitor C112 for establishing capacitive coupling between the resonators 151 and 152, a capacitor C123 for establishing capacitive coupling between the resonators 152 and 153, a capacitor C134 for establishing capacitive coupling between the resonators 153 and 154, a capacitor C145 for establishing capacitive coupling between the resonators 154 and 155, a capacitor C156 for establishing capacitive coupling between the resonators 155 and 156, and a capacitor C167 for establishing capacitive coupling between the resonators 156 and 157.

In the present embodiment, the resonator 152 and the resonator 156 are magnetically coupled to each other although they are not adjacent to each other in circuit configuration.

Further, in the present embodiment, the resonator 153 and the resonator 155 are capacitively coupled to each other although they are not adjacent to each other in circuit configuration. In FIG. 16, the capacitor symbol C135 represents the capacitive coupling between the resonators 153 and 155.

The resonators 151, 152, 153, 154, 155, 156 and 157 respectively include resonator conductor portions 1510, 1520, 1530, 1540, 1550, 1560 and 1570 each of which is formed of a conductor line. Each of the resonator conductor portions 1510, 1520, 1530, 1540, 1550, 1560 and 1570 extends in a direction orthogonal to the Z direction.

Each of the resonator conductor portions 1510, 1520, 1530, 1540, 1550, 1560 and 1570 has a first end and a second end which are opposite ends of the conductor line. As mentioned above, each of the resonators 151 to 157 is a resonator with open ends. Thus, both of the first and second ends of each of the resonator conductor portions 1510, 1520, 1530, 1540, 1550, 1560 and 1570 are open. Each of the resonator conductor portions 1510, 1520, 1530, 1540, 1550, 1560 and 1570 has a length of one half or nearly one half the wavelength corresponding to the center frequency of the passband of the band-pass filter 100.

At least part of the partition 107 extends to pass between the resonator conductor portion 1520 and the resonator conductor portion 1560 and is in contact with the first portion 61 and the second portion 62. In the present embodiment, specifically, the partition 107 extends in the Z direction. The partition 107 connects the first portion 61 and the second portion 62 via the shortest path.

The partition 107 runs through the two or more dielectric layers constituting the main portion 21. In the present embodiment, the partition 107 includes a plurality of through hole lines 107T each running through the two or more dielectric layers constituting the main portion 21, and a conductor layer 107C. In FIG. 15, each through hole line 107T is represented by a circular column. Each of the through hole lines 107T includes two or more through holes connected in series. Each of the through hole lines 107T extends in the Z direction. The through hole lines 107T are arranged to be adjacent to each other in the Y direction. In the present embodiment, the number of the through hole lines 107T is five.

The connecting portion 63 of the shield 6 includes a plurality of through hole lines 163T each running through the two or more dielectric layers constituting the main portion 21. In FIG. 15, each through hole line 163T is represented by a circular column. All the through hole lines represented by circular columns in FIG. 15, except the five through hole lines 107T, are the through hole lines 163T. Each of the through hole lines 163T includes two or more through holes connected in series. Each of the through hole lines 163T extends in the Z direction.

Reference is now made to FIG. 17 to FIG. 24 to describe an example of the dielectric layers constituting the multilayer stack 20 of the present embodiment and the configuration of a plurality of conductor layers formed on the dielectric layers and a plurality of through holes formed in the dielectric layers. In this example, the multilayer stack 20 includes nineteen dielectric layers stacked together. The nineteen dielectric layers will be referred to as the first to nineteenth dielectric layers in the order from bottom to top. The first to nineteenth dielectric layers are denoted by reference numerals 131 to 149, respectively. The main portion 21 is composed of the first to eighteenth dielectric layers 131 to 148. The coating portion 22 is composed of the nineteenth dielectric layer 149. In FIG. 17 to FIG. 23, each circle represents a through hole.

Figure 17:
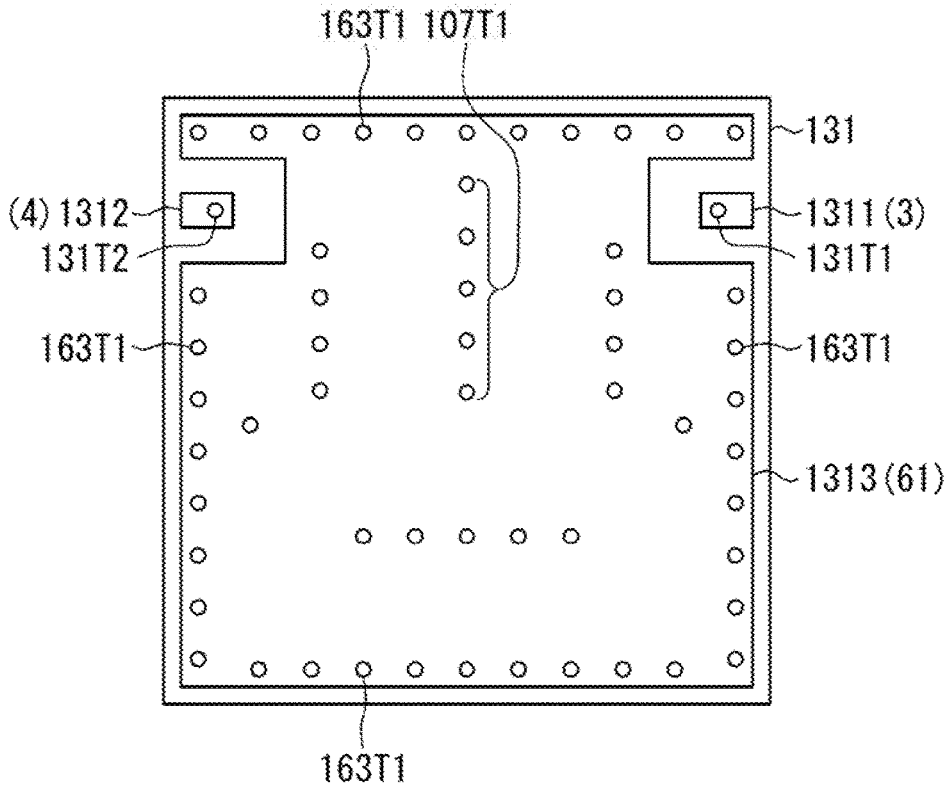
FIG. 17 is an explanatory diagram showing a patterned surface of a first dielectric layer of the multilayer stack shown in FIG. 15.

FIG. 17 shows a patterned surface of the first dielectric layer 131. On the patterned surface of the first dielectric layer 131, there are formed a conductor layer 1311 forming the first input/output port 3, a conductor layer 1312 forming the second input/output port 4, and the first conductor layer 1313 forming the first portion 61 of the shield 6.

Further, a through hole 131T1 connected to the conductor layer 1311, and a through hole 131T2 connected to the conductor layer 1312 are formed in the dielectric layer 131. Further formed in the dielectric layer 131 are five through holes 107T1 constituting respective portions of the five through hole lines 107T, and a plurality of through holes 163T1 constituting respective portions of the plurality of through hole lines 163T. All the through holes represented by circles in FIG. 17, except the through holes 131T1, 131T2 and 107T1, are the through holes 163T1. The through holes 107T1 and 163T1 are connected to the first conductor layer 1313.

Figure 18:
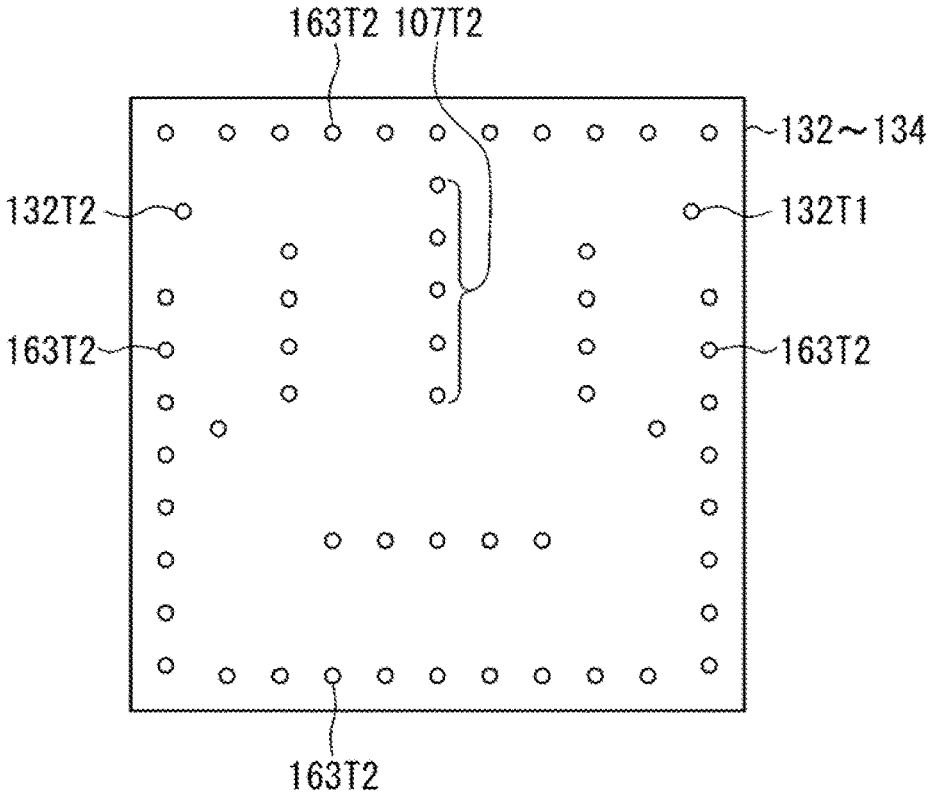
FIG. 18 is an explanatory diagram showing a patterned surface of each of a second to a fourth dielectric layer of the multilayer stack shown in FIG. 15.

FIG. 18 shows a patterned surface of each of the second to fourth dielectric layers 132 to 134. Through holes 132T1 and 132T2 are formed in each of the dielectric layers 132 to 134. The through holes 131T1 and 131T2 shown in FIG. 17 are respectively connected to the through holes 132T1 and 132T2 formed in the second dielectric layer 132.

Five through holes 107T2 constituting respective portions of the five through hole lines 107T are further formed in each of the dielectric layers 132 to 134. The five through holes 107T1 shown in FIG. 17 are respectively connected to the five through holes 107T2 formed in the second dielectric layer 132.

Further formed in each of the dielectric layers 132 to 134 are a plurality of through holes 163T2 constituting respective portions of the plurality of through hole lines 163T. All the through holes represented by circles in FIG. 18, except the through holes 132T1, 132T2 and 107T2, are the through holes 163T2. The plurality of through holes 163T1 shown in FIG. 17 are respectively connected to the plurality of through holes 163T2 formed in the second dielectric layer 132.

In the dielectric layers 132 to 134, every vertically adjacent through holes denoted by the same reference signs are connected to each other.

Figure 19:
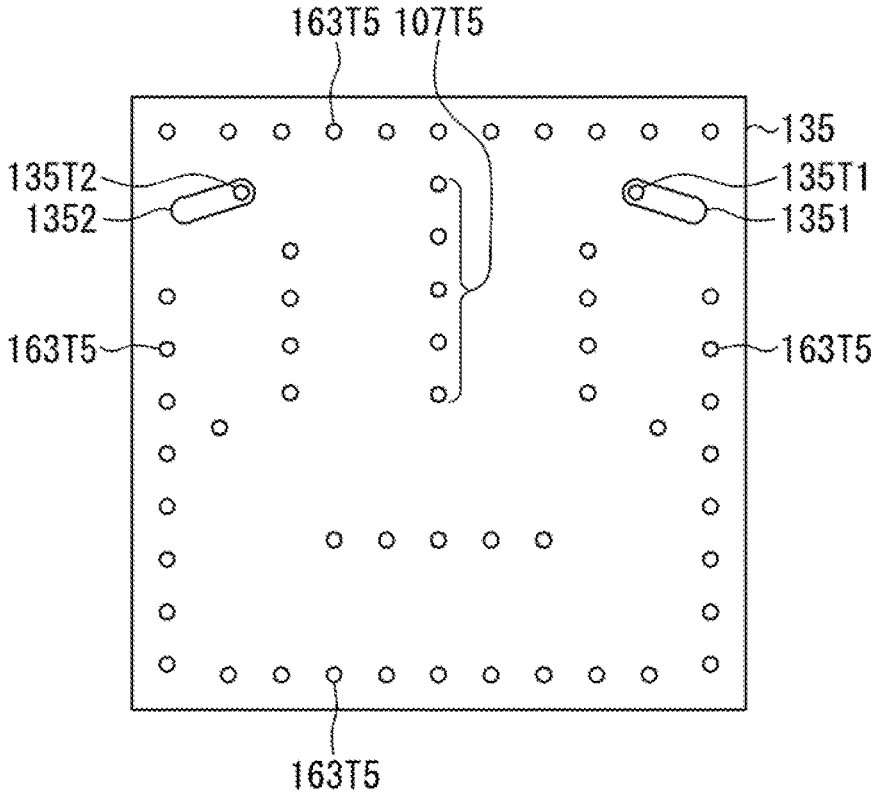
FIG. 19 is an explanatory diagram showing a patterned surface of a fifth dielectric layer of the multilayer stack shown in FIG. 15.

FIG. 19 shows a patterned surface of the fifth dielectric layer 135. Conductor layers 1351 and 1352 are formed on the patterned surface of the dielectric layer 135. Each of the conductor layers 1351 and 1352 has a first end and a second end opposite to each other. The through hole 132T1 formed in the fourth dielectric layer 134 is connected to a portion of the conductor layer 1351 near the first end thereof. The through hole 132T2 formed in the fourth dielectric layer 134 is connected to a portion of the conductor layer 1352 near the first end thereof.

In the dielectric layer 135, there are formed a through hole 135T1 connected to a portion of the conductor layer 1351 near the second end thereof, and a through hole 135T2 connected to a portion of the conductor layer 1352 near the second end thereof.

Further formed in the dielectric layer 135 are five through holes 107T5 constituting respective portions of the five through hole lines 107T. The five through holes 107T2 formed in the fourth dielectric layer 134 are respectively connected to the five through holes 107T5.

Further formed in the dielectric layer 135 are a plurality of through holes 163T5 constituting respective portions of the plurality of through hole lines 163T. All the through holes represented by circles in FIG. 19, except the through holes 135T1, 135T2 and 107T5, are the through holes 163T5. The plurality of through holes 163T2 formed in the fourth dielectric layer 134 are respectively connected to the plurality of through holes 163T5.

Figure 20:
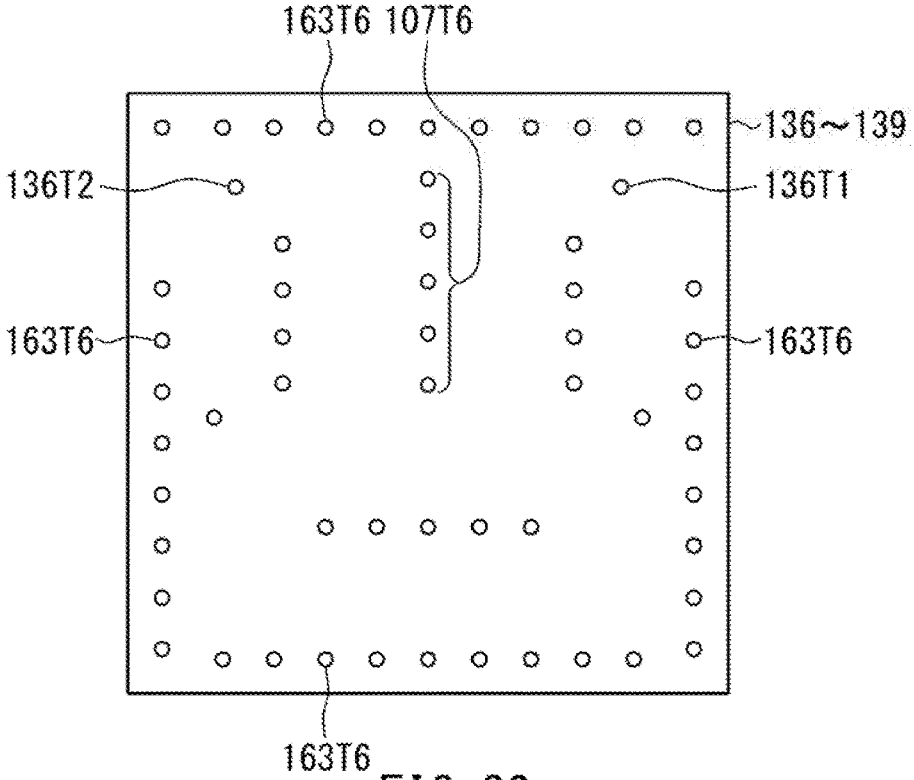
FIG. 20 is an explanatory diagram showing a patterned surface of each of a sixth to a ninth dielectric layer of the multilayer stack shown in FIG. 15.

FIG. 20 shows a patterned surface of each of the sixth to ninth dielectric layers 136 to 139. Through holes 136T1 and 136T2 are formed in each of the dielectric layers 136 to 139. The through holes 135T1 and 135T2 shown in FIG. 19 are respectively connected to the through holes 136T1 and 136T2 formed in the sixth dielectric layer 136.

In each of the dielectric layers 136 to 139, there are further formed five through holes 107T6 constituting respective portions of the five through hole lines 107T. The five through holes 107T5 shown in FIG. 19 are respectively connected to the five through holes 107T6 formed in the sixth dielectric layer 136.

Further, a plurality of through holes 163T6 constituting respective portions of the plurality of through hole lines 163T are formed in each of the dielectric layers 136 to 139. All the through holes represented by circles in FIG. 20, except the through holes 136T1, 136T2 and 107T6, are the through holes 163T6. The plurality of through holes 163T5 shown in FIG. 19 are respectively connected to the plurality of through holes 163T6 formed in the sixth dielectric layer 136.

In the dielectric layers 136 to 139, every vertically adjacent through holes denoted by the same reference signs are connected to each other.

Figure 21:
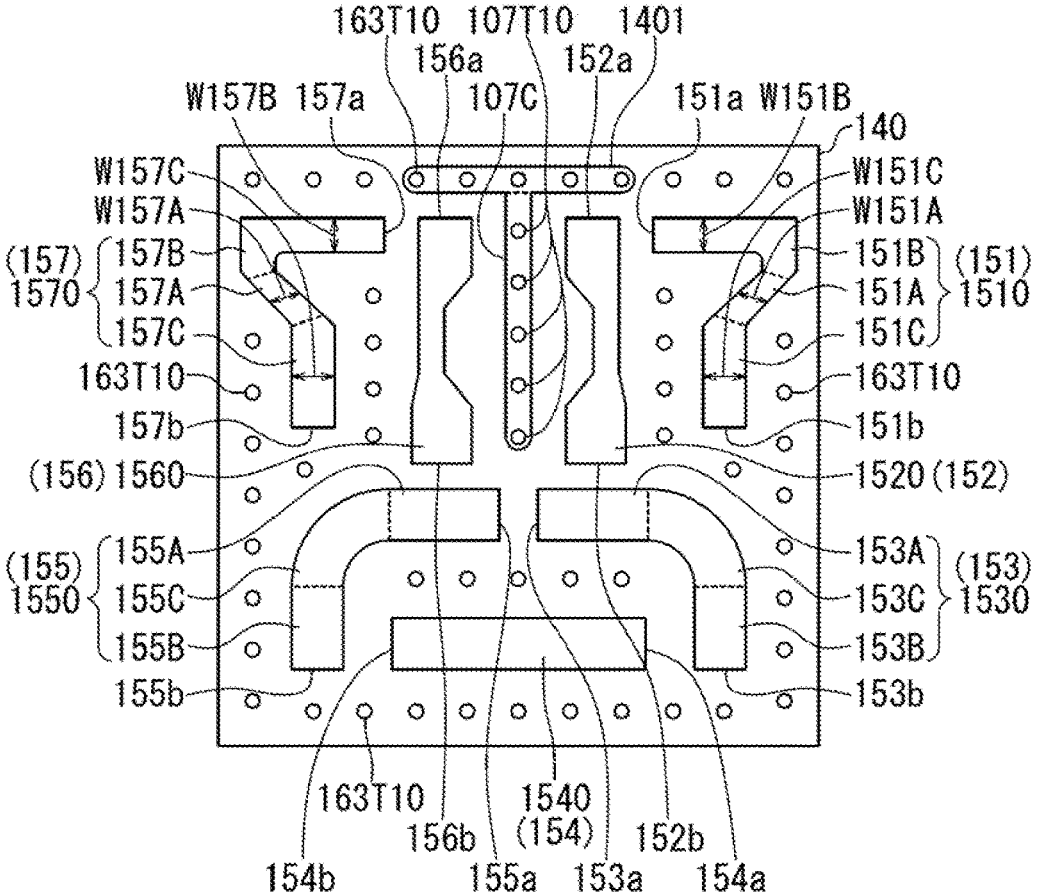
FIG. 21 is an explanatory diagram showing a patterned surface of a tenth dielectric layer of the multilayer stack shown in FIG. 15.
Figure 25:
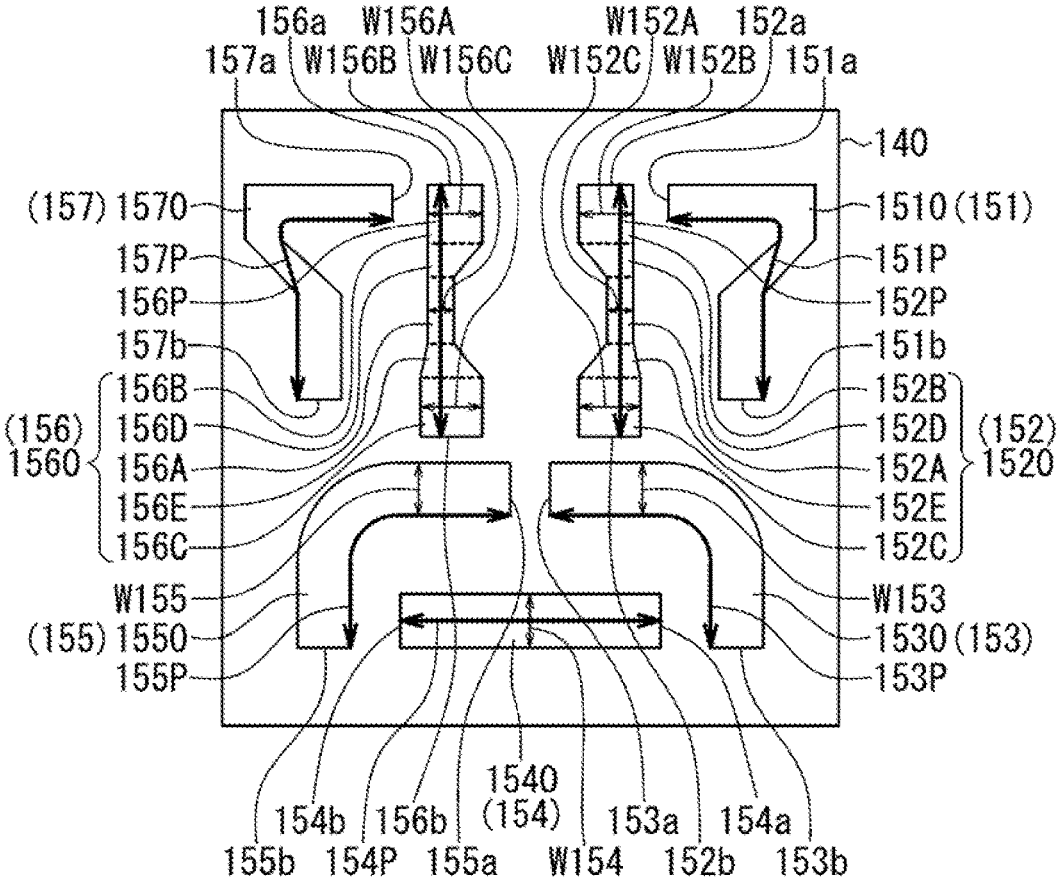
FIG. 25 is an explanatory diagram for explaining the configuration of a plurality of resonator conductor portions of the second embodiment of the invention.

FIG. 21 shows a patterned surface of the tenth dielectric layer 140. The resonator conductor portions 1510, 1520, 1530, 1540, 1550, 1560 and 1570 are formed on the patterned surface of the dielectric layer 140. Now, a detailed description will be given of the configuration of the resonator conductor portions 1510, 1520, 1530, 1540, 1550, 1560 and 1570 with reference to FIG. 21 and FIG. 25. FIG. 25 is an explanatory diagram for explaining the configuration of the resonator conductor portions 1510, 1520, 1530, 1540, 1550, 1560 and 1570.

The resonator conductor portion 1510 has a first end 151*a* and a second end 151*b* which are opposite ends of the conductor line. The resonator conductor portion 1520 has a first end 152*a* and a second end 152*b* which are opposite ends of the conductor line. The resonator conductor portion 1530 has a first end 153*a* and a second end 153*b* which are opposite ends of the conductor line. The resonator conductor portion 1540 has a first end 154*a* and a second end 154*b* which are opposite ends of the conductor line. The resonator conductor portion 1550 has a first end 155*a* and a second end 155*b* which are opposite ends of the conductor line. The resonator conductor portion 1560 has a first end 156*a* and a second end 156*b* which are opposite ends of the conductor line. The resonator conductor portion 1570 has a first end 157*a* and a second end 157*b* which are opposite ends of the conductor line.

The thick arrows in FIG. 25 represent the shortest paths 151P, 152P, 153P, 154P, 155P, 156P and 157P connecting the respective first and second ends of the resonator conductor portions 1510, 1520, 1530, 1540, 1550, 1560 and 1570. Each shortest path corresponds to the shortest current path in the resonator conductor portion.

As shown in FIG. 21, the resonator conductor portion 1510 includes a narrow portion 151A, a first wide portion 151B located between the narrow portion 151A and the first end 151*a*, and a second wide portion 151C located between the narrow portion 151A and the second end 151*b*. In the present embodiment, the first wide portion 151B includes the first end 151*a*, and the second wide portion 151C includes the second end 151*b*, in particular. In FIG. 21 the boundary between the narrow portion 151A and the first wide portion 151B, and the boundary between the narrow portion 151A and the second wide portion 151C are shown in broken lines. Most part of the first wide portion 151B extends in the X direction. Most part of the second wide portion 151C extends in the Y direction. The narrow portion 151A connects an end of the first wide portion 151B opposite from the first end 151*a* and an end of the second wide portion 151C opposite from the second end 151*b*. The narrow portion 151A has a width W151A smaller than a width W151B of the first wide portion 151B and a width W151C of the second wide portion 151C.

As shown in FIG. 21, the resonator conductor portion 1570 includes a narrow portion 157A, a first wide portion 157B located between the narrow portion 157A and the first end 157*a*, and a second wide portion 157C located between the narrow portion 157A and the second end 157*b*. In the present embodiment, the first wide portion 157B includes the first end 157*a*, and the second wide portion 157C includes the second end 157*b*, in particular. In FIG. 21 the boundary between the narrow portion 157A and the first wide portion 157B, and the boundary between the narrow portion 157A and the second wide portion 157C are shown in broken lines. Most part of the first wide portion 157B extends in the X direction. Most part of the second wide portion 157C extends in the Y direction. The narrow portion 157A connects an end of the first wide portion 157B opposite from the first end 157*a* and an end of the second wide portion 157C opposite from the second end 157*b*. The narrow portion 157A has a width W157A smaller than a width W157B of the first wide portion 157B and a width W157C of the second wide portion 157C.

The through hole 136T1 formed in the ninth dielectric layer 139 is connected to the narrow portion 151A of the resonator conductor portion 1510. The through hole 136T2 formed in the ninth dielectric layer 139 is connected to the narrow portion 157A of the resonator conductor portion 1570.

The resonator conductor portions 1520 and 1560 each extend in the Y direction. The resonator conductor portions 1520 and 1560 are adjacent to each other in the X direction and located at a predetermined distance from each other. The distance between the resonator conductor portions 1520 and 1560 is sufficiently smaller than the length of each of the resonator conductor portions 1520 and 1560.

As shown in FIG. 25, the resonator conductor portion 1520 includes a narrow portion 152A, a first wide portion 152B located between the narrow portion 152A and the first end 152*a*, a second wide portion 152C located between the narrow portion 152A and the second end 152*b*, and two coupling portions 152D and 152E. In the present embodiment, the first wide portion 152B includes the first end 152*a*, and the second wide portion 151C includes the second end 152*b*, in particular. The coupling portion 152D connects an end of the narrow portion 152A and an end of the first wide portion 152B opposite from the first end 152*a*. The coupling portion 152E connects the other end of the narrow portion 152A and an end of the second wide portion 152C opposite from the second end 152*b*. In FIG. 25 the boundary between the narrow portion 152A and the coupling portion 152D, the boundary between the narrow portion 152A and the coupling portion 152E, the boundary between the first wide portion 152B and the coupling portion 152D, and the boundary between the second wide portion 152C and the coupling portion 152E are shown in broken lines. The first end 152*a* is located near the first end 151*a* of the resonator conductor portion 1510.

The narrow portion 152A has a width W152A, the first wide portion 152B has a width W152B, and the second wide portion 152C has a width W152C, each of the widths W152A, W152B and W152C being constant regardless of position in the Y direction. The width W152A is smaller than the widths W152B and W152C. The width W152C is greater than the width W152B. The coupling portions 152D and 152E vary in width depending on the position in the Y direction. The width of the coupling portion 152D is equal to that of the narrow portion 152A at the boundary between the coupling portion 152D and the narrow portion 152A, and equal to that of the first wide portion 152B at the boundary between the coupling portion 152D and the first wide portion 152B. The width of the coupling portion 152E is equal to that of the narrow portion 152A at the boundary between the coupling portion 152E and the narrow portion 152A, and equal to that of the second wide portion 152C at the boundary between the coupling portion 152E and the second wide portion 152C.

As shown in FIG. 25, the resonator conductor portion 1560 includes a narrow portion 156A, a first wide portion 156B located between the narrow portion 156A and the first end 156*a*, a second wide portion 156C located between the narrow portion 156A and the second end 156*b*, and two coupling portions 156D and 156E. In the present embodiment, the first wide portion 156B includes the first end 156*a*, and the second wide portion 156C includes the second end 156*b*, in particular. The coupling portion 156D connects an end of the narrow portion 156A and an end of the first wide portion 156B opposite from the first end 156*a*. The coupling portion 156E connects the other end of the narrow portion 156A and an end of the second wide portion 156C opposite from the second end 156*b*. In FIG. 25 the boundary between the narrow portion 156A and the coupling portion 156D, the boundary between the narrow portion 156A and the coupling portion 156E, the boundary between the first wide portion 156B and the coupling portion 156D, and the boundary between the second wide portion 156C and the coupling portion 156E are shown in broken lines. The first end 156*a* is located near the first end 157*a* of the resonator conductor portion 1570.

The narrow portion 156A has a width W156A, the first wide portion 156B has a width W156B, and the second wide portion 156C has a width W156C, each of the widths W156A, W156B and W156C being constant regardless of position in the Y direction. The width W156A is smaller than the widths W156B and W156C. The width W156C is greater than the width W156B. The coupling portions 156D and 156E vary in width depending on the position in the Y direction. The width of the coupling portion 156D is equal to that of the narrow portion 156A at the boundary between the coupling portion 156D and the narrow portion 156A, and equal to that of the first wide portion 156B at the boundary between the coupling portion 156D and the first wide portion 156B. The width of the coupling portion 156E is equal to that of the narrow portion 156A at the boundary between the coupling portion 156E and the narrow portion 156A, and equal to that of the second wide portion 156C at the boundary between the coupling portion 156E and the second wide portion 156C.

As shown in FIG. 21, the resonator conductor portion 1530 includes a first portion 153A, a second portion 153B, and a third portion 153C. The first portion 153A includes the first end 153*a*, and the second portion 153B includes the second end 153*b*. The first portion 153A extends in the X direction, and the second portion 153B extends in the Y direction. The third portion 153C connects an end of the first portion 153A opposite from the first end 153*a* and an end of the second portion 153B opposite from the second end 153*b*. In FIG. 21 the boundary between the first portion 153A and the third portion 153C and the boundary between the second portion 153B and the third portion 153C are shown in broken lines. The first end 153*a* is located near the second end 152*b* of the resonator conductor portion 1520. The resonator conductor portion 1530 has a width W153, the width W153 being constant between the first end 153*a* and the second end 153*b*.

As shown in FIG. 21, the resonator conductor portion 1550 includes a first portion 155A, a second portion 155B, and a third portion 155C. The first portion 155A includes the first end 155*a*, and the second portion 155B includes the second end 155*b*. The first portion 155A extends in the X direction, and the second portion 155B extends in the Y direction. The third portion 155C connects an end of the first portion 155A opposite from the first end 155*a* and an end of the second portion 155B opposite from the second end 155*b*. In FIG. 21 the boundary between the first portion 155A and the third portion 155C and the boundary between the second portion 155B and the third portion 155C are shown in broken lines. The first end 155*a* is located near the second end 156*b* of the resonator conductor portion 1560. The resonator conductor portion 1550 has a width W155, the width W155 being constant between the first end 155*a* and the second end 155*b*.

The first end 153*a* of the resonator conductor portion 1530 and the first end 155*a* of the resonator conductor portion 1550 are adjacent to each other and located at a predetermined distance from each other.

The resonator conductor portion 1540 extends in the X direction. The first end 154*a* is located near the second end 153*b* of the resonator conductor portion 1530. The second end 154*b* is located near the second end 155*b* of the resonator conductor portion 1550. The resonator conductor portion 1540 has a width W154, the width W154 being constant between the first end 154*a* and the second end 154*b*.

Now, components formed on/in the dielectric layer 140 other than the resonator conductor portions 1510, 1520, 1530, 1540, 1550, 1560 and 1570 will be described with reference to FIG. 21. On the patterned surface of the dielectric layer 140, there are formed the conductor layer 107C forming a portion of the partition 107, and a conductor layer 1401. The conductor layer 107C is located between the resonator conductor portions 1520 and 1550 and extends in the Y direction. The conductor layer 1401 extends in the X direction. The conductor layer 1401, at its portion near the center in the longitudinal direction, is connected to an end of the conductor layer 107C. In FIG. 21 the boundary between the conductor layer 107C and the conductor layer 1401 is shown in a broken line.

Further, five through holes 107T10 constituting respective portions of the five through hole lines 107T are formed in the dielectric layer 140. The five through holes 107T10 are connected to the conductor layer 107C. The five through holes 107T6 formed in the ninth dielectric layer 139 are respectively connected to the five through holes 107T10.

Further formed in the dielectric layer 140 are a plurality of through holes 163T10 constituting respective portions of the plurality of through hole lines 163T. All the through holes represented by circles in FIG. 21, except the through holes 107T10, are the through holes 163T10. The plurality of through holes 163T6 formed in the ninth dielectric layer 139 are respectively connected to the plurality of through holes 163T10.

Figure 22:
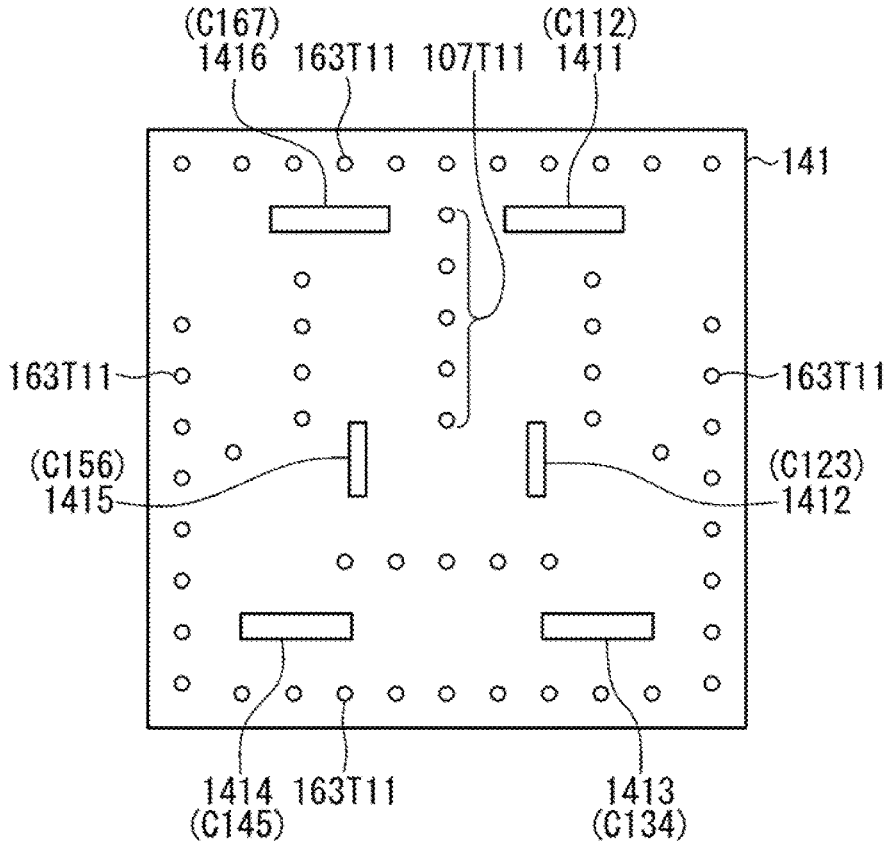
FIG. 22 is an explanatory diagram showing a patterned surface of an eleventh dielectric layer of the multilayer stack shown in FIG. 15.

FIG. 22 shows a patterned surface of the eleventh dielectric layer 141. Conductor layers 1411, 1412, 1413, 1414, 1415 and 1416 for forming the capacitors C112, C123, C134, C145, C156 and C167 shown in FIG. 16 are formed on the patterned surface of the dielectric layer 141.

Further, five through holes 107T11 constituting respective portions of the five through hole lines 107T are formed in the dielectric layer 141. The five through holes 107T10 shown in FIG. 21 are respectively connected to the five through holes 107T11.

Further formed in the dielectric layer 141 are a plurality of through holes 163T11 constituting respective portions of the plurality of through hole lines 163T. All the through holes represented by circles in FIG. 22, except the through holes 107T11, are the through holes 163T11. The plurality of through holes 163T10 shown in FIG. 21 are respectively connected to the plurality of through holes 163T11.

Figure 23:
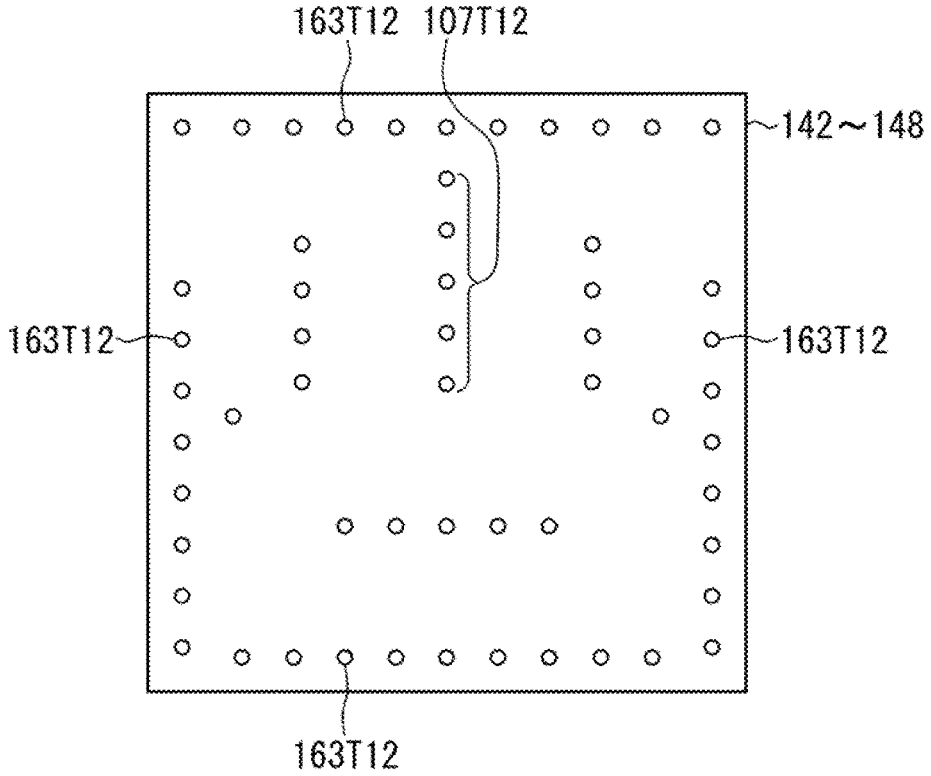
FIG. 23 is an explanatory diagram showing a patterned surface of each of a twelfth to an eighteenth dielectric layer of the multilayer stack shown in FIG. 15.

FIG. 23 shows a patterned surface of each of the twelfth to eighteenth dielectric layers 142 to 148. Five through holes 107T12 constituting respective portions of the five through hole lines 107T are formed in each of the dielectric layers 142 to 148. The five through holes 107T11 shown in FIG. 22 are respectively connected to the five through holes 107T12 formed in the twelfth dielectric layer 142.

Further, a plurality of through holes 163T12 constituting respective portions of the plurality of through hole lines 163T are formed in each of the dielectric layers 142 to 148. All the through holes represented by circles in FIG. 23, except the through holes 107T12, are the through holes 163T12. The plurality of through holes 163T11 shown in FIG. 22 are respectively connected to the plurality of through holes 163T12 formed in the twelfth dielectric layer 142.

In the dielectric layers 142 to 148, every vertically adjacent through holes denoted by the same reference signs are connected to each other.

Figure 24:
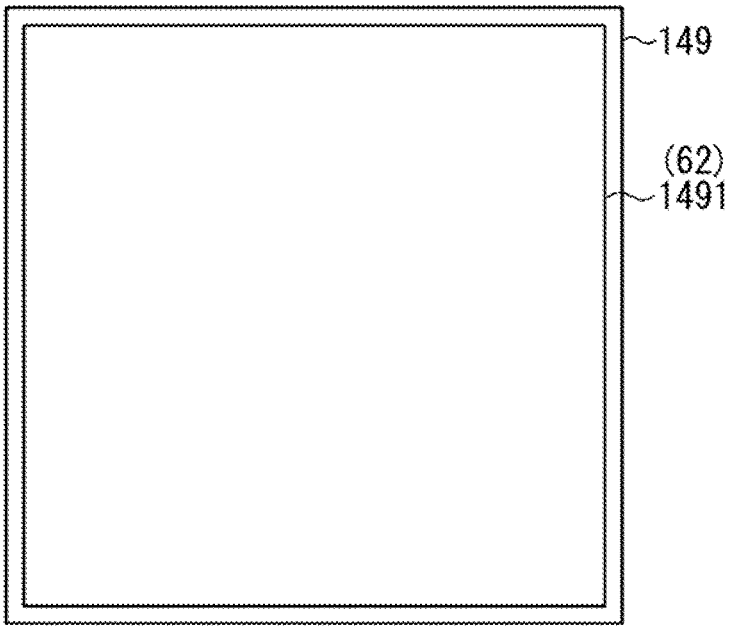
FIG. 24 is an explanatory diagram showing a patterned surface of a nineteenth dielectric layer of the multilayer stack shown in FIG. 15.

FIG. 24 shows a patterned surface of the nineteenth dielectric layer 149. The second conductor layer 1491 forming the second portion 62 of the shield 6 is formed on the patterned surface of the dielectric layer 149. The through holes 107T12 and 163T12 formed in the eighteenth dielectric layer 148 are connected to the second conductor layer 1491.

The band-pass filter 100 according to the present embodiment is formed by stacking the first to nineteenth dielectric layers 131 to 149 such that the patterned surface of the first dielectric layer 131 also serves as the first end face 2A of the main body 2. A surface of the nineteenth dielectric layer 149 opposite from the patterned surface serves as the second end face 2B of the main body 2. The first to nineteenth dielectric layers 131 to 149 constitute the multilayer stack 20.

The respective resonator conductor portions 1510, 1520, 1530, 1540, 1550, 1560 and 1570 of the resonators 151 to 157 are located at the same position in the Z direction within the multilayer stack 20.

The conductor layer 1311 forming the first input/output port 3 is connected to the narrow portion 151A of the resonator conductor portion 1510 shown in FIG. 21 via the through holes 131T1 and 132T1, the conductor layer 1351, and the through holes 135T1 and 136T1.

The conductor layer 1312 forming the second input/output port 4 is connected to the narrow portion 157A of the resonator conductor portion 1570 shown in FIG. 21 via the through holes 131T2 and 132T2, the conductor layer 1352, and the through holes 135T2 and 136T2.

The conductor layer 1411 shown in FIG. 22 is opposed to a portion of the resonator conductor portion 1510 near the first end 151*a* and to a portion of the resonator conductor portion 1520 near the first end 152*a*, with the dielectric layer 140 interposed between the conductor layer 1411 and each of the resonator conductor portions 1510 and 1520. The capacitor C112 shown in FIG. 16 is composed of the conductor layer 1411, the resonator conductor portions 1510 and 1520, and the dielectric layer 140 interposed between the conductor layer 1411 and the resonator conductor portions 1510 and 1520.

The conductor layer 1412 shown in FIG. 22 is opposed to a portion of the resonator conductor portion 1520 near the second end 152*b* and to a portion of the resonator conductor portion 1530 near the first end 153*a*, with the dielectric layer 140 interposed between the conductor layer 1412 and each of the resonator conductor portions 1520 and 1530. The capacitor C123 shown in FIG. 16 is composed of the conductor layer 1412, the resonator conductor portions 1520 and 1530, and the dielectric layer 140 interposed between the conductor layer 1412 and the resonator conductor portions 1520 and 1530.

The conductor layer 1413 shown in FIG. 22 is opposed to a portion of the resonator conductor portion 1530 near the second end 153*b* and to a portion of the resonator conductor portion 1540 near the first end 154*a*, with the dielectric layer 140 interposed between the conductor layer 1413 and each of the resonator conductor portions 1530 and 1540. The capacitor C134 shown in FIG. 16 is composed of the conductor layer 1413, the resonator conductor portions 1530 and 1540, and the dielectric layer 140 interposed between the conductor layer 1413 and the resonator conductor portions 1530 and 1540.

The conductor layer 1414 shown in FIG. 22 is opposed to a portion of the resonator conductor portion 1540 near the second end 154*b* and to a portion of the resonator conductor portion 1550 near the second end 155*b*, with the dielectric layer 140 interposed between the conductor layer 1414 and each of the resonator conductor portions 1540 and 1550. The capacitor C145 shown in FIG. 16 is composed of the conductor layer 1414, the resonator conductor portions 1540 and 1550, and the dielectric layer 140 interposed between the conductor layer 1414 and the resonator conductor portions 1540 and 1550.

The conductor layer 1415 shown in FIG. 22 is opposed to a portion of the resonator conductor portion 1550 near the first end 155*a* and to a portion of the resonator conductor portion 1560 near the second end 156*b*, with the dielectric layer 140 interposed between the conductor layer 1415 and each of the resonator conductor portions 1550 and 1560. The capacitor C156 shown in FIG. 16 is composed of the conductor layer 1415, the resonator conductor portions 1550 and 1560, and the dielectric layer 140 interposed between the conductor layer 1415 and the resonator conductor portions 1550 and 1560.

The conductor layer 1416 shown in FIG. 22 is opposed to a portion of the resonator conductor portion 1560 near the first end 156*a* and to a portion of the resonator conductor portion 1570 near the first end 157*a*, with the dielectric layer 140 interposed between the conductor layer 1416 and each of the resonator conductor portions 1560 and 1570. The capacitor C167 shown in FIG. 16 is composed of the conductor layer 1416, the resonator conductor portions 1560 and 1570, and the dielectric layer 140 interposed between the conductor layer 1416 and the resonator conductor portions 1560 and 1570.

Each of the five through hole lines 107T of the partition 107 is formed by connecting the through holes 107T1, 107T2, 107T5, 107T6, 107T10, 107T11 and 107T12 in series in the Z direction.

In the example shown in FIG. 17 to FIG. 24, the partition 107 extends to pass between the resonator conductor portion 1520 and the resonator conductor portion 1560, and is in contact with the first portion 61 and the second portion 62.

Each of the plurality of through hole lines 163T of the connecting portion 63 is formed by connecting the through holes 163T1, 163T2, 163T5, 163T6, 163T10, 163T11 and 163T12 in series in the Z direction.

In the present embodiment, N is an integer greater than or equal to 5, and is specifically 7. Further, in the present embodiment the fourth stage resonator 154 is the middle resonator. The N resonators in the present embodiment includes a first pair of first and second resonators and a second pair of first and second resonators. The first resonator of the first pair of first and second resonators is the first stage resonator 151. The second resonator of the first pair of first and second resonators is the N-th stage resonator, i.e., the seventh stage resonator 157. The first resonator of the second pair of first and second resonators is the second stage resonator 152. The second resonator of the second pair of first and second resonators is the N−1-th stage resonator, i.e., the sixth stage resonator. The resonator conductor portions 1510 and 1520 each correspond to the first resonator conductor portion. The resonator conductor portions 1560 and 1570 each correspond to the second resonator conductor portion.

In the present embodiment, there are three third resonators. Specifically, the third to fifth stage resonators 153, 154 and 155 are the third resonators. The resonator conductor portions 1530, 1540 and 1550 each correspond to the third resonator conductor portion.

As described previously, each of the resonator conductor portions 1510, 1520, 1560 and 1570 includes the narrow portion, the first wide portion, and the second wide portion. The resonators 151, 152, 156 and 167 are thus SIRs.

Each of the resonator conductor portions 1530, 1540 and 1550 includes no portion having a width smaller than the width at each of the first end and the second end. In the present embodiment, in particular, each of the resonator conductor portions 1530, 1540 and 1550 has a width constant between the first end and the second end. None of the resonators 153, 154 and 155 are SIRs.

The resonators 151, 152, 156 and 157 are each lower in unloaded Q than the resonators 153, 154 and 155.

The shortest paths 152P and 156P of the resonator conductor portions 1520 and 1560 are each smaller in length than the shortest paths 153P, 154P and 155P of the resonator conductor portions 1530, 1540 and 1550.

According to the present embodiment, since the resonators 151, 152, 156 and 157 configured as SIRs can achieve size reduction, it becomes possible to miniaturize the band-pass filter 100. Further, according to the present embodiment, since only the resonators 151, 152, 156 and 157 are configured as SIRs, it is possible to reduce an increase in insertion loss of the band-pass filter 100.

An example of unloaded Qs of the resonators 151 to 157 of the present embodiment will now be shown. In this example, the first and seventh stage resonators 151 and 157 have an unloaded Q of 182. The second and sixth stage resonators 152 and 156 have an unloaded Q of 206. The third and fifth stage resonators 153 and 155 have an unloaded Q of 235. The fourth stage resonator 154 has an unloaded Q of 247. Thus, in this example, each of the first, second, sixth and seventh stage resonators 151, 152, 156 and 157 is lower in unloaded Q than the third to fifth stage resonators 153 to 155.

Next, a description will be given of the results of a simulation on the band-pass filter 100 according to the present embodiment. The simulation determined the frequency response of insertion loss for each of first to fourth models of the band-pass filter 100. The first to fourth models have different combinations of unloaded Qs of the resonators 151 to 157.

In the first model, all the resonators 151 to 157 have an unloaded Q of 200. In the second model, the resonators 151 and 157 have an unloaded Q of 100, and the resonators 152 to 156 have an unloaded Q of 200. In the third model, the resonators 152 and 156 have an unloaded Q of 100, and the resonators 151, 153, 154, 155 and 157 have an unloaded Q of 200. In the fourth model, the resonators 153 and 155 have an unloaded Q of 100, and the resonators 151, 152, 154, 156 and 157 have an unloaded Q of 200.

Figure 26:
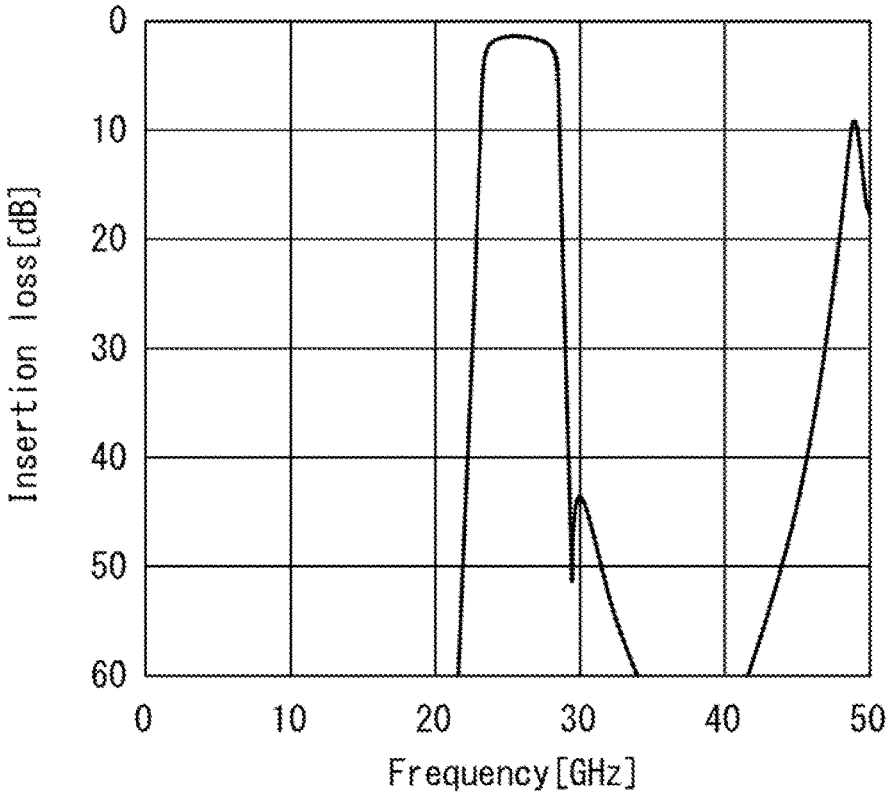
FIG. 26 is a characteristic chart showing the results of a simulation on the band-pass filter according to the second embodiment of the invention.
Figure 27:
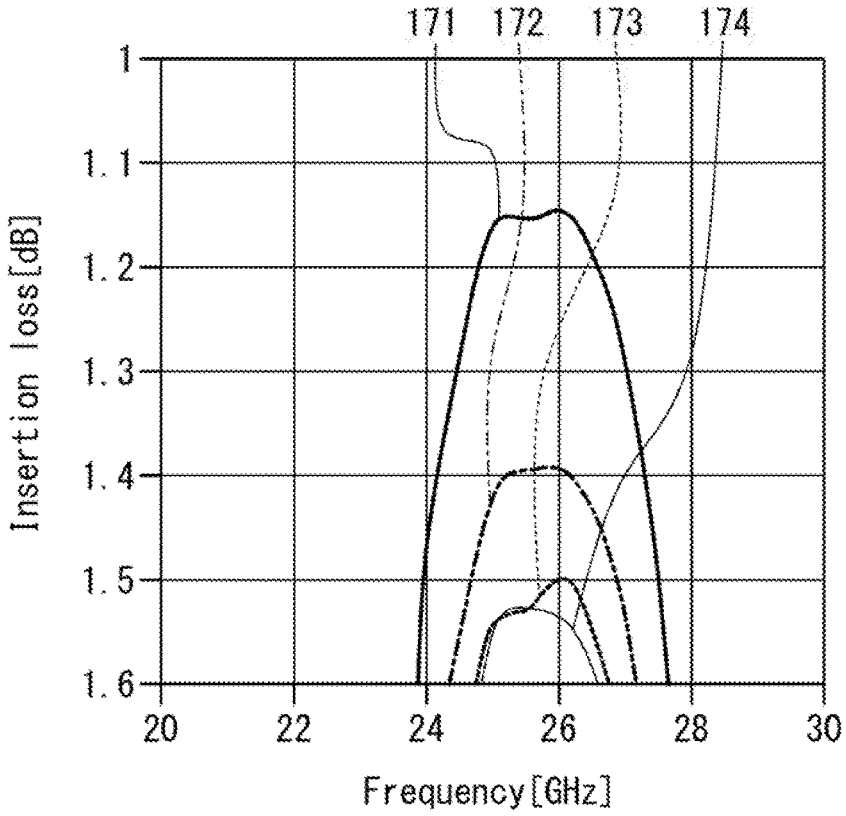
FIG. 27 is a characteristic chart showing a part of FIG. 26 on an enlarged scale.

FIG. 26 shows the frequency response of the insertion loss of the first to fourth models. FIG. 27 shows a part of FIG. 26 on an enlarged scale. In FIGS. 26 and 27 the horizontal axis represents frequency, and the vertical axis represents insertion loss. In FIG. 27 the curves designated by the reference numerals 171, 172, 173 and 174 represent the characteristics of the first, second, third and fourth models, respectively.

The center frequency of the passband of each of the first to fourth models is approximately 26 GHz. As shown in FIG. 27, the second to fourth models each exhibit a larger insertion loss at the center frequency of the passband as compared to the first model. When the second to fourth models are compared in terms of insertion loss at the center frequency of the passband, the second model is the smallest in insertion loss, and the third model is the second smallest in insertion loss. This indicates that a resonator that is located closer to the first input/output port 3 or the second input/output port 4 in circuit configuration is lower in the ratio of the amount of change in insertion loss to the amount of change in unloaded Q. Therefore, in the case of configuring only some of the resonators as SIRs, an increase in insertion loss can be reduced by selecting a resonator located closer to the first input/output port 3 or the second input/output port 4 to be an SIR, rather than a middle resonator or a resonator located near the middle resonator in circuit configuration.

Figure 28:
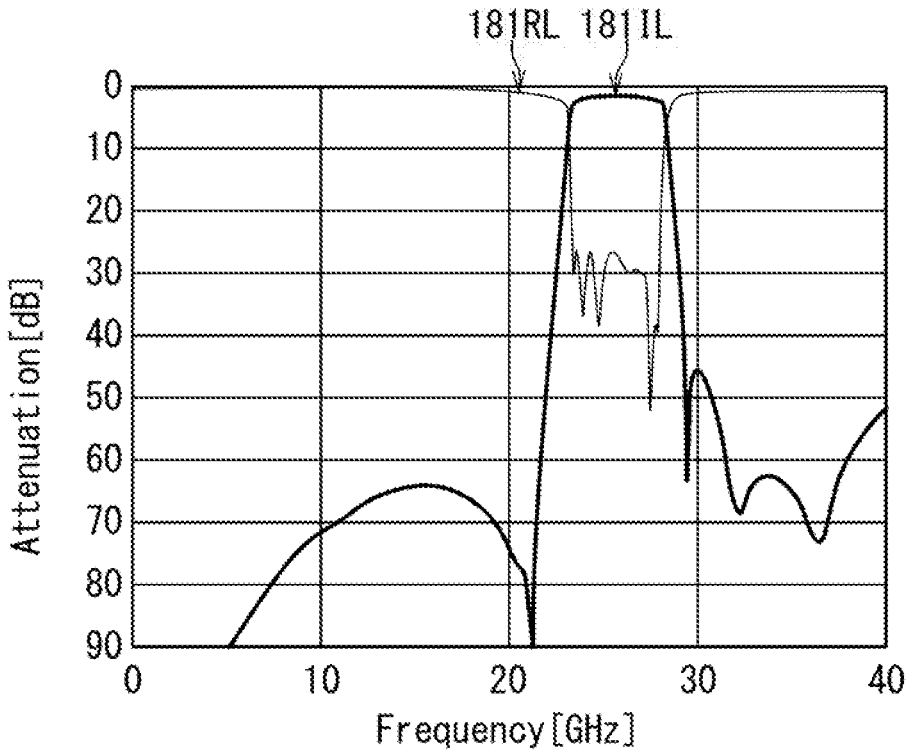
FIG. 28 is a characteristic chart showing an example of frequency responses of insertion loss and return loss of the band-pass filter according to the second embodiment of the invention.

FIG. 28 shows an example of frequency responses of the insertion loss and return loss of the band-pass filter 100 according to the present embodiment. In FIG. 28 the horizontal axis represents frequency, and the vertical axis represents attenuation. In FIG. 28 the curve designated by the reference symbol 181IL represents the frequency response of the insertion loss, and the curve designated by the reference symbol 181RL represents the frequency response of the return loss.

The configuration, operation and effects of the present embodiment are otherwise the same as those of the first embodiment.

The present invention is not limited to the foregoing embodiments, and various modifications may be made thereto. For example, the number and the configuration of the resonators are not limited to those illustrated in the foregoing embodiments, and can be freely chosen as far as the requirements of the appended claims are met.

Obviously, many modifications and variations of the present invention are possible in the light of the above teachings. Thus, it is to be understood that, within the scope of the appended claims and equivalents thereof, the invention may be practiced in other embodiments than the foregoing most preferable embodiments.

What is claimed is:

1. A band-pass filter comprising:

a main body formed of a dielectric;

a first input/output port and a second input/output port integrated with the main body; and N resonators provided within the main body, located between the first input/output port and the second input/output port in circuit configuration, and configured so that electromagnetic coupling is established between every two of the resonators adjacent to each other in circuit configuration, wherein N is an integer greater than or equal to 3, the N resonators include at least a pair of first and second resonators, the first and second resonators being non-adjacent to each other in circuit configuration, and a third resonator located between the first and second resonators in circuit configuration, when one of the N resonators that is i-th closest to the first input/output port in circuit configuration is referred to as an i-th stage resonator, the first resonator is an i-th stage resonator where i has a value smaller than (N+1)/2, and the second resonator is an i-th stage resonator where i has a value greater than (N+1)/2, the first resonator includes a first resonator conductor portion formed of a conductor line, the second resonator includes a second resonator conductor portion formed of a conductor line, the third resonator includes a third resonator conductor portion formed of a conductor line, each of the first to third resonator conductor portions has a first end and a second end which are opposite ends of the corresponding conductor line, each of the first and second resonator conductor portions includes a narrow portion, a first wide portion located between the narrow portion and the first end, and a second wide portion located between the narrow portion and the second end, the narrow portion being smaller in width than the first and second wide portions, the width being a dimension in a direction orthogonal to a shortest path connecting the first end and the second end, the third resonator conductor portion includes no portion having a width smaller than a width at each of the first end and the second end, and each of the first and second resonators is lower in unloaded Q than the third resonator.

2. The band-pass filter according to claim 1, wherein each of the first to third resonators is a resonator with open ends.

3. The band-pass filter according to claim 1, wherein

N is an integer greater than or equal to 5, the N resonators include a first pair of first and second resonators, and a second pair of first and second resonators, the first resonator of the first pair of first and second resonators is a first stage resonator, the second resonator of the first pair of first and second resonators is an N-th stage resonator, the first resonator of the second pair of first and second resonators is a second stage resonator, and the second resonator of the second pair of first and second resonators is an N−1-th stage resonator.

4. The band-pass filter according to claim 1, wherein each of the first and second resonator conductor portions is smaller in length of the shortest path than the third resonator conductor portion.

5. The band-pass filter according to claim 1, wherein the first resonator is a first stage resonator, and the second resonator is an N-th stage resonator.

6. A band-pass filter comprising:

a main body formed of a dielectric;

a first input/output port and a second input/output port integrated with the main body; and N resonators provided within the main body, located between the first input/output port and the second input/output port in circuit configuration, and configured so that electromagnetic coupling is established between every two of the resonators adjacent to each other in circuit configuration, wherein N is an integer greater than or equal to 3, the N resonators include at least a pair of first and second resonators, the first and second resonators being non-adjacent to each other in circuit configuration, and a third resonator located between the first and second resonators in circuit configuration, when one of the N resonators that is i-th closest to the first input/output port in circuit configuration is referred to as an i-th stage resonator, the first resonator is an i-th stage resonator where i has a value smaller than (N+1)/2, and the second resonator is an i-th stage resonator where i has a value greater than (N+1)/2, the first resonator includes a first resonator conductor portion formed of a conductor line, the second resonator includes a second resonator conductor portion formed of a conductor line, the third resonator includes a third resonator conductor portion formed of a conductor line, each of the first to third resonator conductor portions has a first end and a second end which are opposite ends of the corresponding conductor line, each of the first and second resonator conductor portions includes a narrow portion, a first wide portion located between the narrow portion and the first end, and a second wide portion located between the narrow portion and the second end, the narrow portion being smaller in width than the first and second wide portions, the width being a dimension in a direction orthogonal to a shortest path connecting the first end and the second end, each of the first and second resonator conductor portions is smaller in length of the shortest path than the third resonator conductor portion, and each of the first and second resonators is lower in unloaded Q than the third resonator.

7. The band-pass filter according to claim 6, wherein

N is an integer greater than or equal to 5, the N resonators include a first pair of first and second resonators, and a second pair of first and second resonators, the first resonator of the first pair of first and second resonators is a first stage resonator, the second resonator of the first pair of first and second resonators is an N-th stage resonator, the first resonator of the second pair of first and second resonators is a second stage resonator, and the second resonator of the second pair of first and second resonators is an N−1-th stage resonator.

8. The band-pass filter according to claim 6, wherein each of the first to third resonators is a resonator with open ends.

9. The band-pass filter according to claim 6, wherein the third resonator conductor portion includes no portion having a width smaller than a width at each of the first end and the second end.

10. The band-pass filter according to claim 6, wherein the first resonator is a first stage resonator, and the second resonator is an N-th stage resonator.

11. A band-pass filter comprising:

a main body formed of a dielectric;

a first input/output port and a second input/output port integrated with the main body; and N resonators provided within the main body, located between the first input/output port and the second input/output port in circuit configuration, and configured so that electromagnetic coupling is established between every two of the resonators adjacent to each other in circuit configuration, wherein N is an integer greater than or equal to 5, the N resonators include at least a pair of first and second resonators, the first and second resonators being non-adjacent to each other in circuit configuration, and a third resonator located between the first and second resonators in circuit configuration, when one of the N resonators that is i-th closest to the first input/output port in circuit configuration is referred to as an i-th stage resonator, the first resonator is an i-th stage resonator where i has a value smaller than (N+1)/2, and the second resonator is an i-th stage resonator where i has a value greater than (N+1)/2, the first resonator includes a first resonator conductor portion formed of a conductor line, the second resonator includes a second resonator conductor portion formed of a conductor line, the third resonator includes a third resonator conductor portion formed of a conductor line, each of the first to third resonator conductor portions has a first end and a second end which are opposite ends of the corresponding conductor line, each of the first and second resonator conductor portions includes a narrow portion, a first wide portion located between the narrow portion and the first end, and a second wide portion located between the narrow portion and the second end, the narrow portion being smaller in width than the first and second wide portions, the width being a dimension in a direction orthogonal to a shortest path connecting the first end and the second end, each of the first and second resonators is lower in unloaded Q than the third resonator, the N resonators include a first pair of first and second resonators, and a second pair of first and second resonators, the first resonator of the first pair of first and second resonators is a first stage resonator, the second resonator of the first pair of first and second resonators is an N-th stage resonator, the first resonator of the second pair of first and second resonators is a second stage resonator, and the second resonator of the second pair of first and second resonators is an N−1-th stage resonator.

12. The band-pass filter according to claim 11, wherein each of the first and second resonator conductor portions is smaller in length of the shortest path than the third resonator conductor portion.

13. The band-pass filter according to claim 11, wherein each of the first to third resonators is a resonator with open ends.

14. The band-pass filter according to claim 11, wherein the third resonator conductor portion includes no portion having a width smaller than a width at each of the first end and the second end.

* * * * *